US009586429B2

(12) United States Patent
Nakagomi

(10) Patent No.: US 9,586,429 B2
(45) Date of Patent: Mar. 7, 2017

(54) POST-PROCESSING APPARATUS AND IMAGE FORMATION APPARATUS PROVIDED WITH THE SAME

(71) Applicant: Takamitsu Nakagomi, Yamanashi-ken (JP)

(72) Inventor: Takamitsu Nakagomi, Yamanashi-ken (JP)

(73) Assignees: CANON FINETECH INC., Misato-Shi, Saitama-Ken (JP); NISCA CORPORATION, Minamikoma-Gun, Yamanashi-Ken (JP)

( * ) Notice: Subject to any disclaimer, the term of this patent is extended or adjusted under 35 U.S.C. 154(b) by 114 days.

(21) Appl. No.: 14/582,721

(22) Filed: Dec. 24, 2014

(65) Prior Publication Data

US 2015/0183255 A1 Jul. 2, 2015

(30) Foreign Application Priority Data

Dec. 27, 2013 (JP) ..... 2013-271341
Nov. 21, 2014 (JP) ..... 2014-236278

(51) Int. Cl.
*B42C 1/12* (2006.01)
*B65H 37/04* (2006.01)
*B65H 43/02* (2006.01)

(52) U.S. Cl.
CPC ..... *B42C 1/12* (2013.01); *B65H 37/04* (2013.01); *B65H 43/02* (2013.01); *B65H 2403/51* (2013.01); *B65H 2407/21* (2013.01); *B65H 2408/1222* (2013.01); *B65H 2801/27* (2013.01)

(58) Field of Classification Search
CPC ..... B42C 1/12; B65H 37/04; B65H 43/02; B65H 2403/51; B65H 2407/21; B65H 2801/27; B65H 2408/1222
USPC ..... 412/11; 270/58.07, 58.08, 58.02, 58.11, 270/58.12, 58.17, 58.27
See application file for complete search history.

(56) References Cited

U.S. PATENT DOCUMENTS 4,878,656 A * 11/1989 Honjo ..... G03G 15/6541 270/37
5,342,034 A * 8/1994 Mandel ..... B42C 1/125 109/56
5,580,039 A * 12/1996 Takehara ..... B65H 39/11 270/58.11
5,639,078 A * 6/1997 Mandel ..... B42C 1/12 270/58.12
6,179,287 B1 * 1/2001 Watanabe ..... B65H 33/10 270/52.03

(Continued)

FOREIGN PATENT DOCUMENTS

JP 2005-096392 A 4/2005
JP 2009-018932 A 1/2009

*Primary Examiner* — Leslie A Nicholson, III
(74) *Attorney, Agent, or Firm* — Manabu Kanesaka

(57) ABSTRACT

A post-processing apparatus includes a first sheet mount section to place sheets in the shape of a bunch, a second sheet mount section to place sheets in the shape of a bunch, a binding processing unit disposed to be able to shift to a first position to bind sheets placed in the first sheet mount section and a second position to bind sheets placed in the second sheet mount section, and a regulation device that does not position the sheets in the shape of a bunch in an area of the binding processing unit when the binding processing unit is not positioned in the second position.

18 Claims, 16 Drawing Sheets

(56) References Cited

U.S. PATENT DOCUMENTS

| | | | | |
|---|---|---|---|---|
| 6,290,220 | B1 * | 9/2001 | Takehara | B42C 1/12 270/58.08 |
| 7,747,212 | B2 * | 6/2010 | Yamamoto | B65H 9/101 270/58.08 |
| 7,866,648 | B2 * | 1/2011 | Noh | G03G 15/6544 270/58.07 |
| 8,104,757 | B2 * | 1/2012 | Taki | B42B 4/00 270/58.08 |
| 8,146,908 | B2 * | 4/2012 | Terao | B27F 7/006 227/2 |
| 9,139,397 | B2 * | 9/2015 | Sato | B42B 9/00 |
| 2014/0334901 | A1 * | 11/2014 | Sato | B42B 9/00 412/12 |
| 2015/0166295 | A1 * | 6/2015 | Kanemaru | B65H 31/02 270/58.08 |

* cited by examiner

NOTE STU=STAPLE UNIT

POST-PROCESSING APPARATUS AND IMAGE FORMATION APPARATUS PROVIDED WITH THE SAME

RELATED APPLICATIONS

The present application is based on, and claims priorities from, Japanese Application No. 2013-271341 filed Dec. 27, 2013 and Japanese Application No. 2014-236278 filed Nov. 21, 2014, the disclosure of which is hereby incorporated by reference herein in its entirety.

BACKGROUND OF THE INVENTION

The present invention relates to a post-processing apparatus for collating and collecting sheets carried out of an image formation apparatus to perform binding processing, and more particularly, to improvements in a manual binding processing mechanism capable of performing binding processing on sheets manually set by a user from the outside.

Generally, this kind of apparatus is known as a finish apparatus that is connected to a sheet discharge outlet of an image formation apparatus and that collates and collects image-formed sheets to perform binding processing. Then, it is also known that a part of the exterior casing is provided with a manual binding mechanism that performs binding processing on a bunch of sheets manually set from the outside.

For example, in Patent Document 1, an apparatus is provided with a first binding processing section and a second binding processing section, in a first post-processing processing section is disposed a mechanism that collects sheets fed from an image formation apparatus to perform binding processing, and in the second binding processing section is disposed a manual binding mechanism that performs binding processing on a bunch of sheets inserted from the outside. In a binding processing mechanism in the Document, an independent binding apparatus is disposed in each of the first post-processing section and the second binding processing section.

Similarly, Patent Document 2 discloses an apparatus provided with first and second binding processing apparatuses. In the apparatus of the Document, a first post-processing section and a second folding processing section are disposed in adjacent positions, and a common binding processing apparatus is configured to shift to positions between both of the binding positions. By thus configuring, it is not necessary that a binding processing apparatus is incorporated into each of the first and second binding processing sections, and it is possible to achieve miniaturization and simplification of the apparatus.

PRIOR ART DOCUMENT

Patent Document

[Patent Document 1] Japanese Patent Application Publication No. 2005-096392

[Patent Document 2] Japanese Patent Application Publication No. 2009-018932

DISCLOSURE OF INVENTION

Problems to be Solved by the Invention

As described above, such an apparatus has already been known that is provided with first and second binding processing sections, where in one of the sections is disposed the mechanism that collects sheets fed from an apparatus on the upstream side to perform binding processing, and in the other section is disposed the binding mechanism that performs binding processing on a bunch of sheets manually inserted by a user.

However, as in Patent Document 1, when the binding processing apparatus (stapler apparatus or the like) is disposed in each of the first and second binding processing sections, increases in size and cost of the apparatus are problems. Further, as in Patent Document 2, in the apparatus that the common binding unit is shifted to positions between the first and second processing sections manually by an operator, the operation of the apparatus is burdensome as compared with the case of automatically shifting the binding unit to positions corresponding to the need in the post-processing process.

Therefore, the inventor of the present invention attempted to automatically shift the binding unit to positions between first and second positions to bind sheets corresponding to conditions of processing process. The inventor noted that in this case, the conditions differ between the time sheets exist in the sheet binding position that is the shift destination and the time sheets do not exist. For example, the apparatus automatically shifts in performing processing by opening an apparatus cover in adding binding needles of the binding processing apparatus, or when a set bunch of sheets causes a paper jam.

Further, in a malfunction that a bunch of sheets sustains damage by the shifting binding processing unit, for example, when a curled sheet protrudes into a shift trajectory of the binding processing unit, end folding or breakage occurs. Furthermore, in the apparatus configuration that a user manually inserts a bunch of sheets in one of the binding processing sections from the outside, when thick sheets, particular film sheets or the like are inserted, there is the case that a failure occurs in the drive section of the binding mechanism.

It is an object of the present invention to provide a post-processing apparatus that is provided with first and second binding processing sections and that is excellent in stability without resulting in breakage or damage of a sheet or apparatus failure in automatically shifting a position of a common binding processing apparatus to binding positions of both of the processing sections.

Means for Solving the Problem

To attain the above-mentioned object, the present invention is characterized by arranging a binding processing unit to be able to shift between a first position to bind sheets placed in a first sheet mount section and a second position to bind sheets placed in a second sheet mount section, and not putting sheets in an area of the binding processing unit when the binding processing unit does not exist in the binding position.

Further, a shift device for shifting the binding processing unit is characterized by controlling to prohibit or stop the shift when sheets exist in the sheet mount section that is the shift destination.

The configuration will be described more specifically. The apparatus is provided with first and second sheet mount sections (12, 25*a*) to place sheets in the shape of a bunch, a binding processing unit (14) disposed to be able to shift between the first and second sheet mount sections, a shift device for shifting the binding processing unit to positions, and a controller (75) for controlling the shift device.

Then, on the controller is provided an identification device for determining whether or not sheets exist in the second sheet mount section, and based on a determination result of the identification device, when sheets exist in the second sheet mount section, the controller prohibits or stops the binding processing unit from shifting to the second position.

Advantageous Effect of the Invention

The present invention is not to put sheets in the area of the binding processing unit when the binding processing unit does not exist in the binding position, and therefore, exhibits the following effects.

By causing not to put sheets in the area when the binding processing unit does not exist in the binding position in shifting a position of the common binding processing unit between first and second positions to bind sheets, any failure does not occur which is caused by contact of the area of the binding processing unit and sheets, and sheets are neither broken nor stained.

Further, the present invention is to provide the identification device for determining whether or not sheets exist in the second sheet mount section, and prohibit or stop the shift when sheets exist in the second sheet mount section in shifting the binding processing unit to positions, and therefore, exhibits the following effect.

The shift is prohibited or stopped when sheets exist in the sheet mount section that is the shift destination in shifting the common binding processing unit to positions between the first and second positions to bind sheets, and therefore, even when sheets such as curled sheets and thick sheets having a fear of providing inhibition of the shift of the processing unit or failure are set in the sheet mount section of the shift destination e.g. a manual insertion section, the shift unit does not shift not to result in a failure. Further, also when sheets are set in the mount section in a disordered posture, the sheets are neither broken nor stained.

Further, in the present invention, also in adopting a mechanism (for example, motor that loses synchronization by an excessive load) that does not need large output as the shift mechanism of the binding processing unit, sheets are not prevented from shifting, and therefore, it is possible to configure the apparatus with more safety.

DETAILED DESCRIPTION OF PREFERRED EMBODIMENTS

The present invention will specifically be described below based on to preferred Embodiments shown in drawings.

[Image Formation System]

Figure 1:
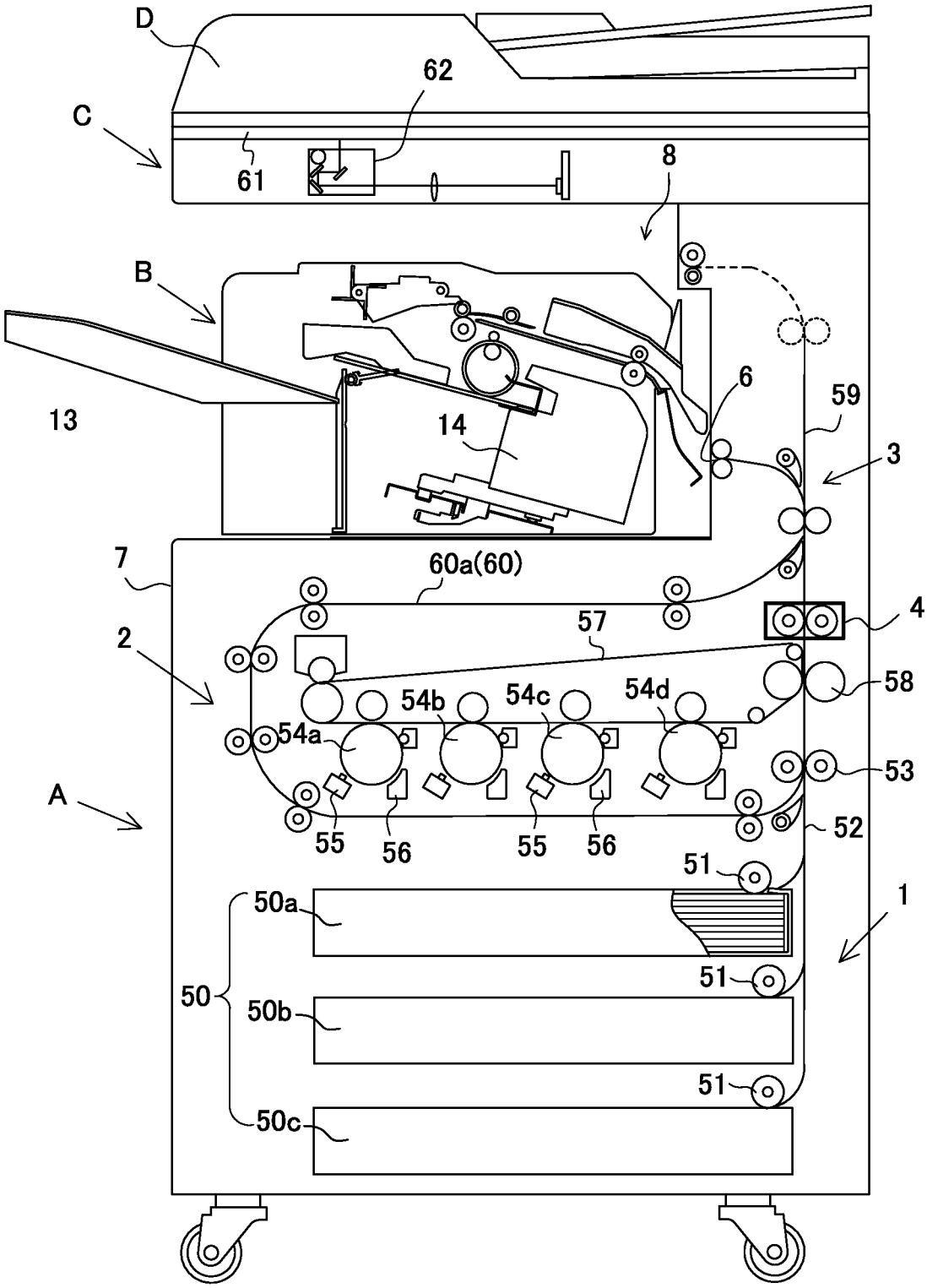
FIG. 1 is an explanatory view of an entire configuration of an image formation system according to the present invention.
Figure 2:
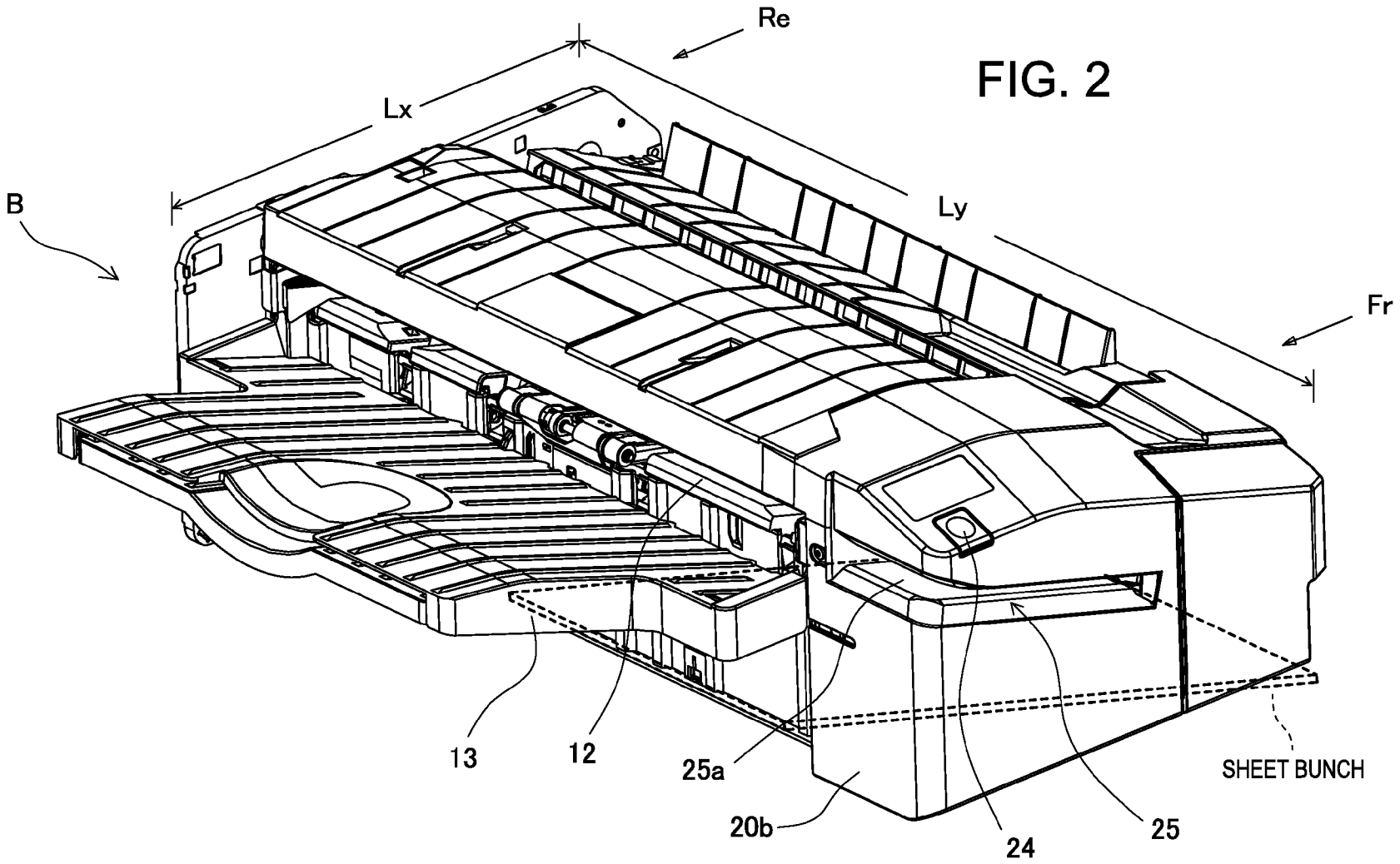
FIG. 2 is an explanatory view of a perspective configuration of a post-processing apparatus in the system of FIG. 1.

FIG. 1 illustrates an image formation system related to the present invention, and the system is comprised of an image formation apparatus A that forms an image on a sheet, and a post-processing apparatus B that collates and collects image-formed sheets to perform binding processing. The image formation apparatus A is in the case of being configured on a standalone basis as a single-function apparatus such as a copier and facsimile apparatus, and in the case of being configured as a terminal apparatus of a computer network or the like.

[Image Formation Apparatus]

As shown in FIG. 1, the image formation apparatus A is comprised of a paper feed section 1, image formation section 2, sheet discharge section 3 and data processing section (note shown). Then, a sheet stored in the paper feed section 1 is fed to the image formation section 2, 2, and the sheet is subjected to image formation, and is fed to the sheet discharge section via a fusing section 4. The sheet discharge section 3 is coupled to the post-processing apparatus B described later. The apparatus of FIG. 1 is provided with a scatter apparatus C having a read section 5 that reads an original image, and a feeder apparatus D that feeds the original to the read section.

An image formation mechanism is disposed in the image formation section 2, and as the mechanism, it is possible to adopt various mechanisms such as an electrostatic image formation mechanism, inkjet image formation mechanism, offset image formation mechanism, thermal transfer image formation mechanism and silk screen image formation mechanism that form an image. Further, the data processing section is provided with a data storage (not shown) that stores image data transferred from the outside (computer network or the like) and a data expansion device (not shown) to form an image.

[Post-Processing Apparatus]

The post-processing apparatus B is comprised of a unit incorporated into the sheet discharge section (sheet discharge area) of the image formation apparatus A, and is provided with a sheet carry-in path 10 continued to a sheet discharge outlet 6 of the image formation apparatus A, a processing tray 12, and a stack tray 13. Then, a sheet fed from the sheet discharge outlet 6 of the image formation apparatus A is guided onto the processing tray from the carry-in path 10 to collate and collect, and sheets are subjected to binding processing with a binding processing device 14 disposed in the processing tray 12, and then, are stored in the stack tray 13 on the downstream side.

Figure 3:
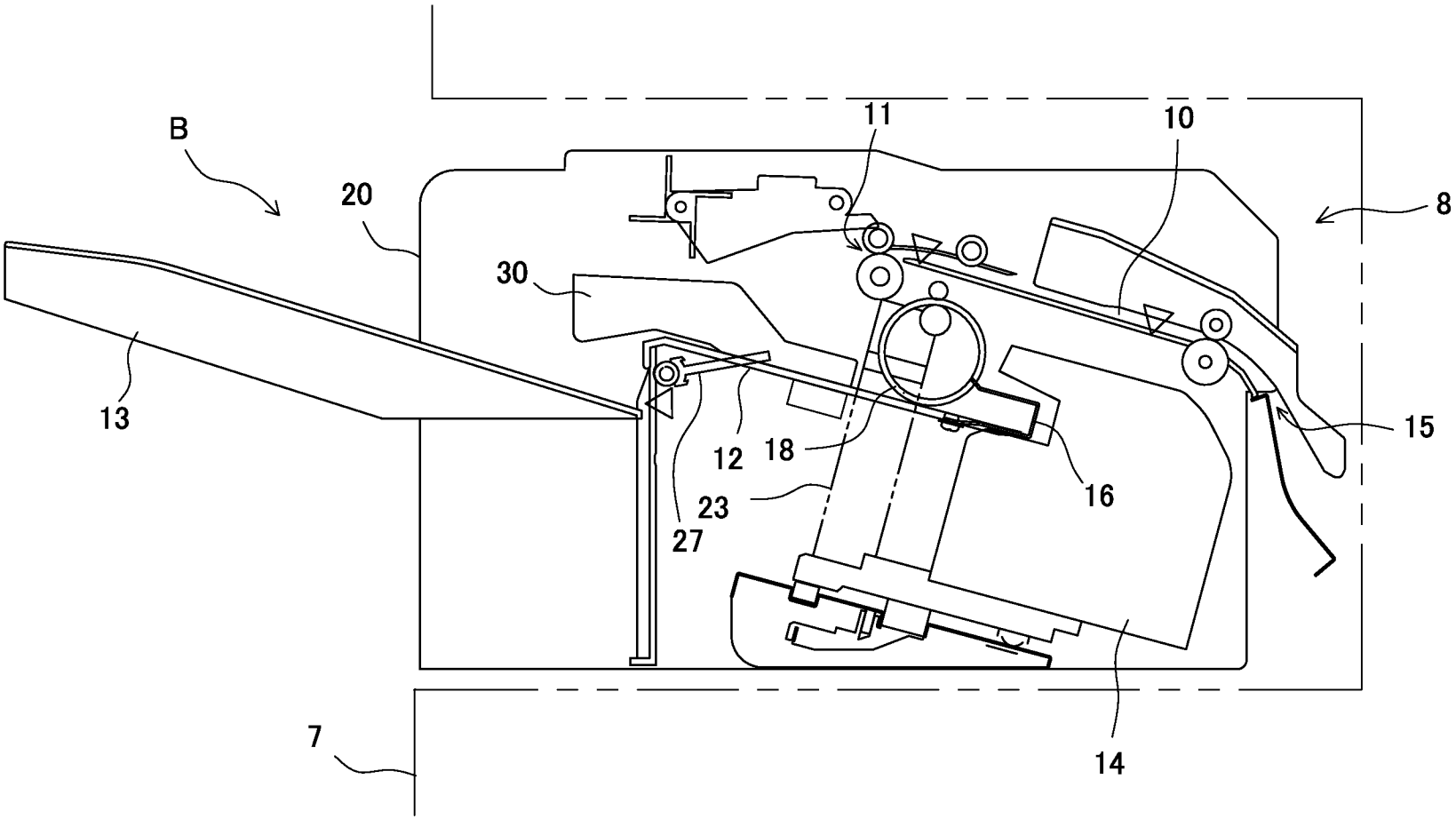
FIG. 3 is an explanatory view of an entire configuration of the post-processing apparatus of FIG. 2.

As shown in FIG. 3 illustrating details, in a housing 7 of the image formation apparatus A, the post-processing apparatus is disposed in the sheet discharge area 8. A housing 20 of the post-processing apparatus B is comprised of a pair of right and left side frames and a stay member (bottom frame or the like) that couples both of the side frames. Then, a carry-in entrance 15 of the sheet carry-in path 10 is disposed to be coupled to the sheet discharge outlet 6 of the image formation apparatus A, the processing tray 12 is disposed on the downstream side of the sheet discharge outlet 6 of the path, and the stack tray 13 is disposed on the downstream side of the tray 12. In the apparatus shown in the figure, the sheet fed from the path sheet discharge outlet 6 is bridge-supported at the rear end portion by the processing tray 12 and at the front end portion by the stack tray 13 (upper surface of loaded sheets).

In the processing tray 12 are disposed a sheet end regulation device 16 for striking the sheet rear end to regulate, and a side alignment device 30 for positioning the sheet side edge (sheet discharge orthogonal direction) in a reference (center reference, side edge reference). Further, in the processing tray 12 are disposed the binding processing device 14 (stapler unit; the same in the following description) for performing binding processing on a bunch of sheets positioned in a predetermined position, and a sheet bunch carrying-out device 17 for storing the bunch of sheets subjected to the binding processing in the stack tray 13 on the downstream side.

The housing 20 of the post-processing apparatus B is provided with a manual set section 25 in which an operator manually inserts a bunch of sheets from the outside so as to enable a bunch of sheets approved from the outside to undergo binding processing. Details of the configuration will be described later.

By the configuration as described above, sheets with images formed in the image formation apparatus A are fed to the post-processing apparatus B, and are collected on the processing tray. The sheets are positioned in the reference position with the sheet end regulation device 16 and alignment device 30, and are subjected to the binding processing with the binding processing device 14. Then, the sheets are stored in the stack tray 13 on the downstream side with the sheet bunch carrying-out device 17. Hereinafter, this series of operation of image formation, collation collection, binding processing and stack storage is referred to online binding processing.

On the other hand, a bunch of sheets set in the manual set section 25 is subjected to the binding processing with the internal binding processing device 14. Hereinafter, the binding processing in the manual insertion section (manual set section) 25 is referred to as offline binding processing. The present invention is characterized in that the binding processing on the processing tray and the binding processing in the manual set section 25 is performed by the binding processing with the common binding processing device 14 (stapler unit). Therefore, a sheet support surface 12*a* of the processing tray 12 and a sheet set surface 25*a* of the manual set section 25 are disposed parallel on almost the same plane, and the stapler unit 14 is disposed to be able to shift to positions between binding positions set on the support surface 12*a* and the set surface 25*a*. A shift device 22 is disposed in the apparatus frame as a shift device including a drive motor that shifts the stapler unit 14 to positions.

[Sheet Alignment Mechanism]

In the processing tray 12 is disposed a sheet alignment mechanism that positions a sheet, which is carried in, in a predetermined position (processing position). The sheet alignment mechanism shown in the figure is comprised of the "sheet end regulation device 16" for regulating the position of the sheet discharge-direction end surface (front end surface or rear end surface) of the sheet fed from the sheet discharge outlet 11, and the "side alignment device 30" for aligning the width in the sheet discharge orthogonal direction (sheet side direction). The description will be given below in this order.

[Sheet End Regulation Device]

The sheet end regulation device 16 shown in the figure is comprised of a rear end regulation member that strikes the rear end edge in the sheet discharge direction to regulate. This rear end regulation member (sheet end regulation device) 16 is provided with a regulation surface 16*a* that strikes and regulates the read end edge in the sheet discharge direction of the sheet which is carried in along the support surface 12*a* on the processing tray, and strikes the rear end edge of the sheet fed with a take-in transport device 18 to halt.

When the stapler 14 described later performs multi-binding, the staple unit shifts along the sheet rear end (in the sheet discharge orthogonal direction). Therefore, in order not to interfere with the unit shift, this rear end regulation member 16 adopts (1) a mechanism that moves and retracts the rear end regulation member 16 into/from a shift path (motion trajectory) of the binding unit, or (2) a mechanism that the member 16 shifts to positions integrally with the binding unit 14, or is comprised of (3) a bent piece, for example, in the shape of a channel, inside binding space comprised of a head and anvil of the binding unit 14.

In the member shown in the figure, the rear end regulation member 16 is comprised of a plate-shaped bent member of cross section in the shape of a C (shape of a channel) disposed inside the binding space of the staple binding device 14. Then, a first member 16A is disposed in a sheet center with respect to a minimum size sheet as a reference, and second and third members 16B, 16C are spaced at a distance away from the member 16A to the right and left thereof (see FIG. 4). By this means, the binding processing device 14 is allowed to shift in the sheet width direction.

Figure 4:
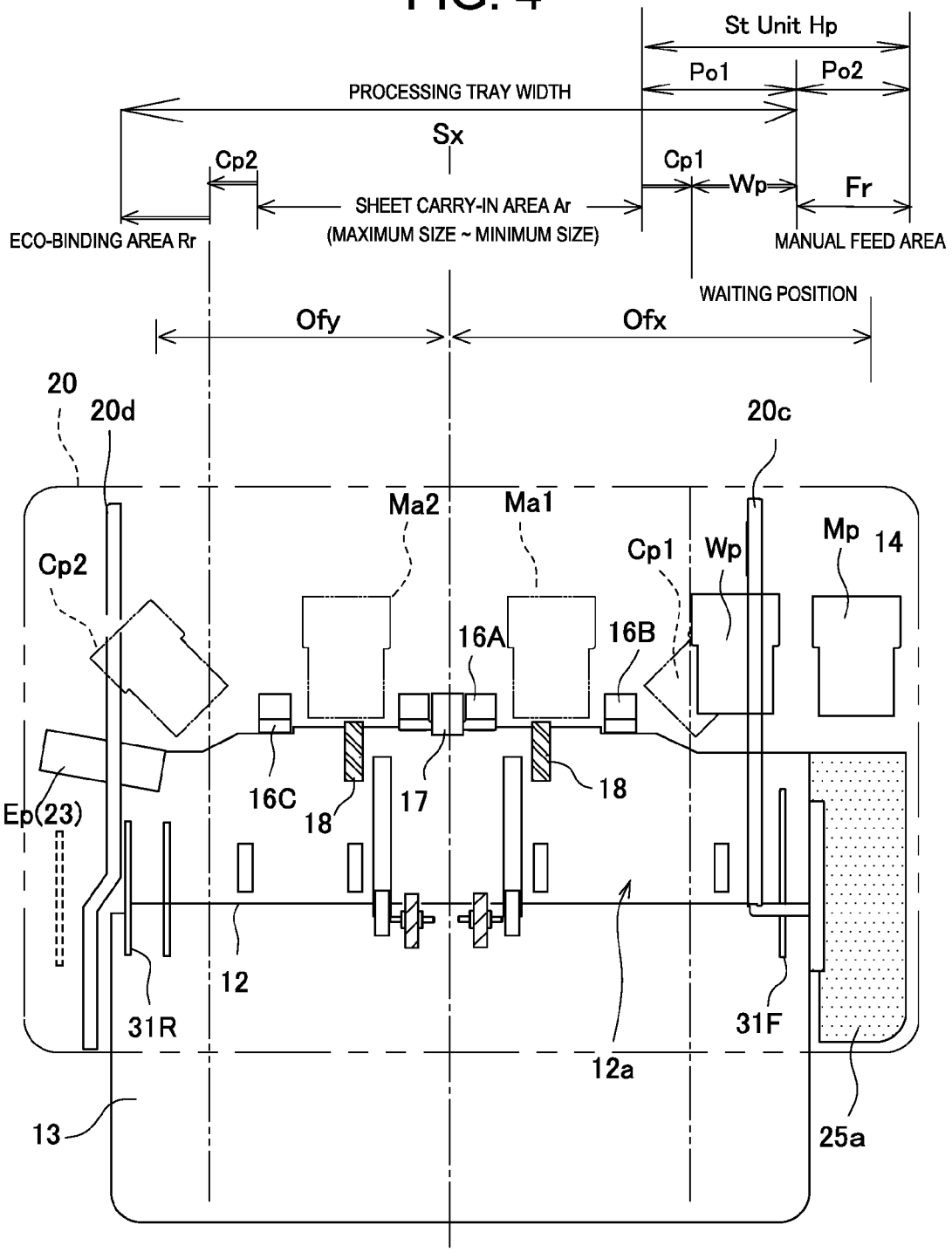
FIG. 4 is an explanatory view of a plan configuration of the post-processing apparatus.
Figure 5:
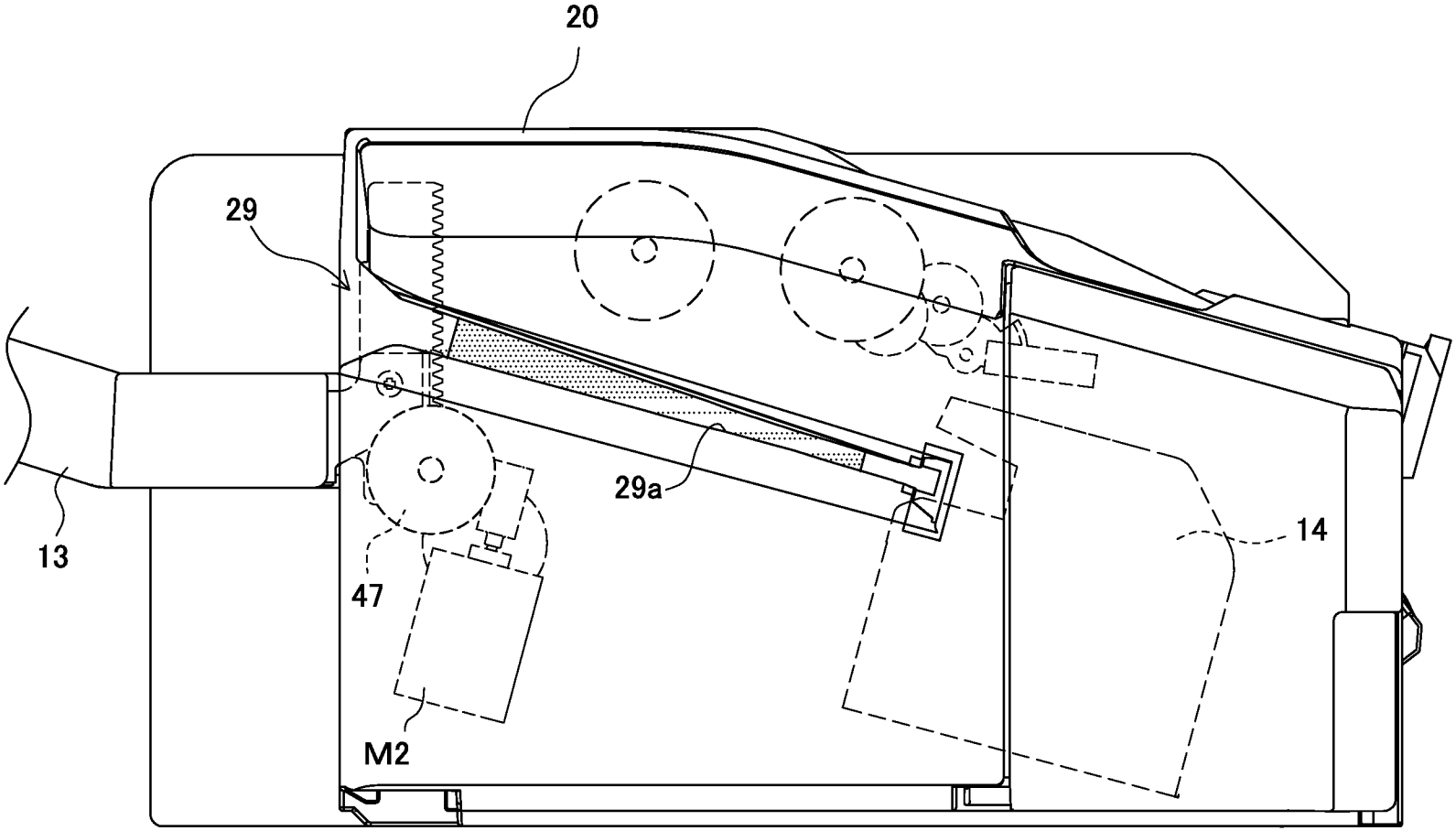
FIG. 5 is an explanatory view of a processing tray and manual set surface of the post-processing apparatus.
Figure 7:
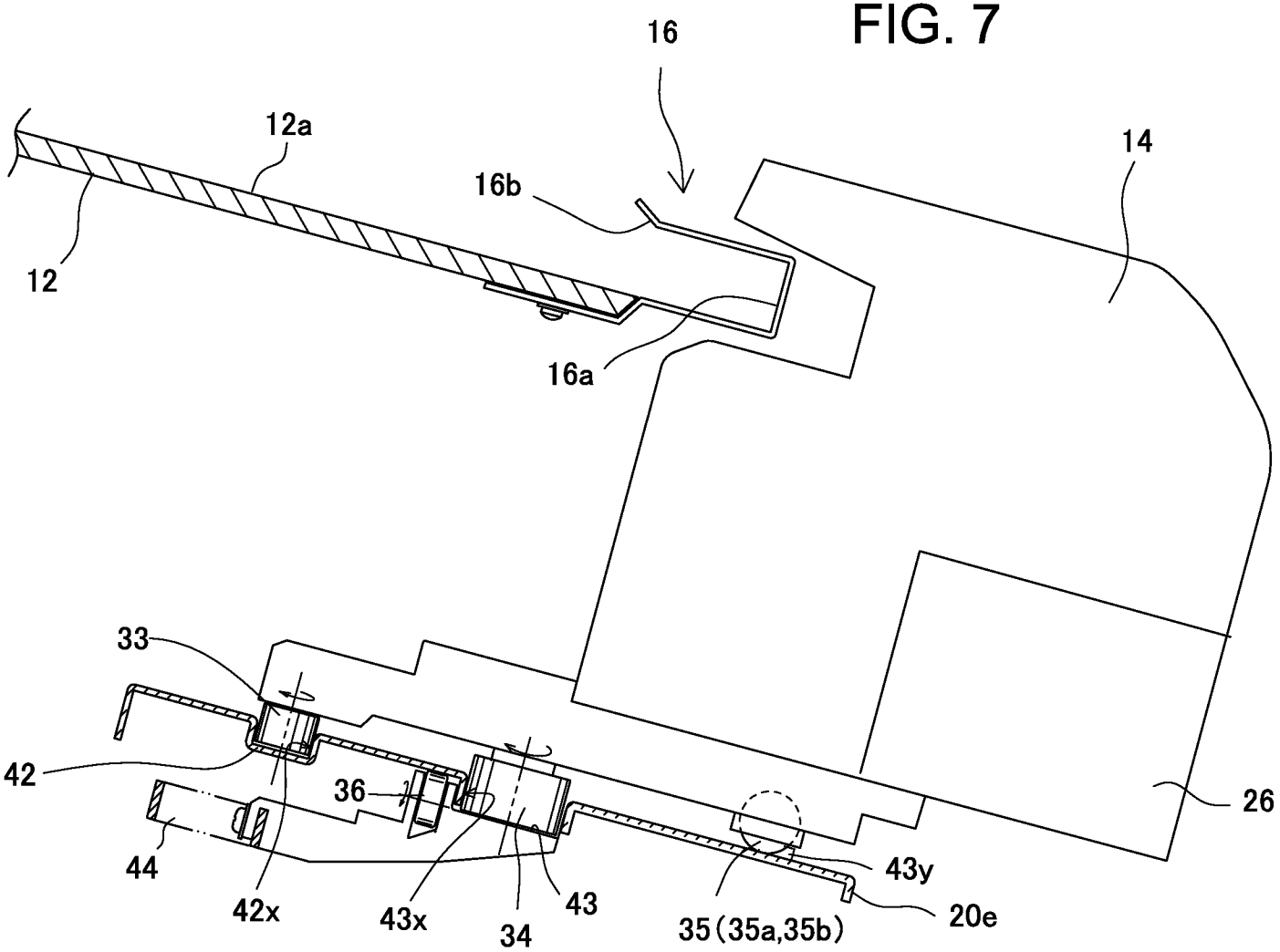
FIG. 7 is an explanatory view of a support structure of the staple unit of FIG. 6.

As shown in FIGS. 4 and 7, to the processing tray 12 is fixed a plurality of rear end regulation members 16 each comprised of the channel-shaped bent piece (the member front end portion is fixed to the tray rear wall with a screw.) The regulation surface 16*a* is formed in each of the rear end regulation member 16A to 16C, and the bent front end portion is connected to an inclined surface 16*b* that guides the sheet end to the regulation surface.

[Side Alignment Device]

In the processing tray 12 is provided the alignment device 30 (hereinafter, referred to as "side alignment member") for positioning the sheet struck by the above-mentioned rear end regulation member 16 in the sheet discharge orthogonal direction (sheet width direction).

The side alignment member 30 is different in the configuration corresponding to that sheets of different sizes are aligned in a center reference on the processing tray or aligned in a side reference. In the apparatus shown in FIG. 4, sheets of different sizes are discharged in the center reference from the sheet discharge outlet 11, and the sheets are aligned in the center reference on the processing tray. Then, a bunch of sheets aligned in the shape of a bunch in the center reference is subjected to the binding processing with the stapler unit 14, in binding positions Ma1, Ma2 in the alignment posture in multi-binding, or in a binding position Cp1 or Cp2 by offsetting the bunch of sheets in the lateral direction by a predetermined amount in right/left corner binding, corresponding to the binding processing.

Therefore, as the alignment device 30, a pair of right and left side alignment members (31F, 31R) are disposed to be mutually opposed, where each of the members 31 protrudes upward from the support surface 12*a* of the processing tray 12 and has a regulation surface 31*x* that engages in the sheet side edge. Then, this pair of right and left side alignment members 31 are disposed in the processing tray 12 to be able to reciprocate at a predetermined stroke. This stroke is set according to a size difference between a maximum size sheet and a minimum size sheet and an offset amount by which a bunch of sheets subsequent to alignment is position-shifted (offset-transported) in either of the right and left directions. In other words, the shift stroke of the right and left side alignment members 31F, 31R is set according to the shift amount to align sheets of different sizes and the offset amount of a bunch of sheets subsequent to alignment.

Therefore, as shown in FIG. 4, the side alignment members 31 are comprised of a right-side alignment member 31F (on the apparatus front side) and a left-side alignment member 31R (on the apparatus rear side), and in both of the side alignment members 31, regulation surfaces 31*x* that engage in the sheet side edges are supported by the tray member to shift in the mutually approach directions or separate directions. In the processing tray 12 are provided slit grooves that penetrate both sides, and the side alignment members 31 having the regulation surfaces 31*x* that engage in the sheet side edges are fitted slidably into the tray upper surface from the slit grooves.

Each of the side alignment members 31F, 31R is supported slidably by a plurality of guide rollers (that may be rail members) on the tray rear side, and racks are integrally formed. The right and left racks are coupled to alignment motors via pinions. Each of the right and left alignment motors is comprised of a stepping motor. A position of each of the right and left alignment members 31F, 31R is detected with a position sensor not shown. Then, using the detection value as a reference, it is configured to enable each regulation member to be shifted to positions in either of the right and left directions by a designated shift amount.

In addition, as a substitute for the rack-pinion mechanism as shown in the figure, it is also possible to adopt a mechanism that each of the side alignment members 31F, 31R is fixed to a timing belt, and that the belt is coupled to a motor to cause right-and-left reciprocating motion with a pulley.

In such a configuration, a controller 75 described later causes the right and left side alignment members 31 to wait in predetermined waiting positions (width size of the sheet+α position), based on the sheet size information provided from the image formation unit A or the like. In this state, a sheet is carried onto the processing tray, and at timing at which the sheet end strikes the sheet end regulation member 16, alignment operation is started. In this alignment operation, the right and left alignment motors (not shown) rotate in the opposite directions (approach directions) by the same amount. Then, the sheet carried in the processing tray 12 is positioned with reference to the sheet center, and is staked in the shape of a bunch. By repeating the sheet carry-in operation and alignment operation, sheets are collated and collected in the shape of a bunch on the processing tray. At this point, sheets of different sizes are positioned in the center reference.

In the sheets which are thus collected on the processing tray in the center reference, it is possible to perform the binding processing (multi-binding processing) on a plurality of portions at predetermined intervals in the sheet rear end edge (or front end edge) in the posture. Further, in the case of performing the binding processing on a sheet corner, one of the right and left side alignment members 31F, 31R is shifted to the designated binding position that is a position with which the sheet side end corresponds and is rested. Then, the side alignment member on the opposite side is shifted to positions in the approach direction. This shift amount in the approach direction is calculated corresponding to the sheet size. By this means, the sheets carried onto the processing tray 12 are aligned so that the right side edge corresponds with the binding position in right corner binding, while being aligned so that the left side edge corresponds with the binding position in the left corner binding position.

In the case of offset-shifting a bunch of sheets aligned in the predetermined position on the processing tray as described above for "eco-binding processing" described later, either of following drive control is adopted:

(1) the alignment member on the rear side in the shift direction is shifted in the transport orthogonal direction by a beforehand set amount, in a state in which the alignment member on the front side in the shift direction is retracted in a position spaced a distance away from an offset scheduled position; and (2) the right and left alignment members are shifted in the transport orthogonal direction by the same amount.

In addition, the position sensors and position sensors such as encode sensors (not shown) are disposed in the right and left side alignment members 31F, 31R and their alignment motors to detect positions of the side alignment members 31. Further, it is possible to control the right and left side alignment members 31F, 31R with a relatively simplified configuration by forming the alignment motors M6, M7 with stepping motors, detecting home positions of the side alignment members 31 with position sensors (not shown), and performing PWM control on the motors.

[Sheet Bunch Carrying-Out Mechanism]

The sheet bunch carrying-out mechanism (sheet bunch carrying-out device 17) shown in FIG. 4 will be described. In the processing tray 12 as described above is disposed the sheet bunch carrying-out mechanism that carries out a bunch of sheets subjected to the binding processing with the first or second binding device 14 or 23 to the stack tray 13 on the downstream side. In the processing tray 12 described according to FIG. 4 are disposed the first sheet rear end regulation member 16A in the sheet center Sx and the second and third sheet rear end regulation members 16B, 16C spaced a distance to the right and left of the member 16*a*. Then, it is configured that a bunch of sheets locked in the regulation members 16 is subjected to the binding processing with the binding device 14 (23), and is carried out to the stack tray 13 on the downstream side. Therefore, the sheet bunch carrying-out device 17 is disposed along the support surface 12*a* in the processing tray 12.

[Binding Processing Method (Binding Position)]

The sheet fed to the carry-in entrance 15 of the sheet carry-in path 10 as described above is collated and collected on the processing tray, and is positioned (aligned) in a beforehand set position and posture by the sheet end regulation members 16 and side alignment member 30. Then, this bunch of sheets is subjected to the binding processing, and is carried out to the stack tray 13 on the downstream side. The binding processing method in this case will be described.

In the apparatus shown in the figure, as the binding processing method, the processing tray 12 is provided with the "first binding device 14 for performing staple processing on a bunch of sheets" and the "second binding device 23 for performing binding on a bunch of sheets without a staple". Then, in the controller 75 described later, it is a first feature that a bunch of sheets is subjected to the binding processing with the first or second selected binding device 14 (23), and then, is carried out to the downstream side. The reason is as described below. When a bunch of sheets is subjected to the binding processing with a staple, it is possible to perform bookbinding that the sheets are not removed easily, but corresponding to use of a user, convenience is sometimes required to easily separate a bunch of bound sheets. Further, the metal needle becomes a problem when a used bunch of sheets is cut with a shredder or the like, the sheets are recycled and the like, and therefore, the reason is to enable the binding device "with a staple" or "without a staple" to be selected and used.

Further, in the apparatus shown in the figure, it is a second feature that sheets prepared outside the apparatus (outside the system) undergo the binding processing (hereinafter, referred to as "manual staple processing"), independently of a series of post-processing operation for carrying in sheets from the sheet carry-in path (sheet discharge path) 10 to collate and collect, and then, performing the binding processing.

Therefore, the manual set section 25 to set a bunch of sheets from the outside is disposed in an exterior casing 20*b*, the manual set surface 25*a* to set the bunch of sheets is formed in the casing, and the staple binding device (staple unit 14) as described previously is configured to shift to positions from a sheet carry-in area Ar of the processing tray 12 to a manual feed area Fr.

Each binding method will be described based on FIG. 4. The apparatus shown in the figure is set for the "multi-binding positions Ma1, Ma2" to perform the binding processing on a plurality of portions of sheets with staples, "corner binding positions Cp1, Cp2" to perform bunch binding processing on a sheet corner, "manual binding position Mp" to perform the binding processing on manually set sheets, and "without-staple binding position Ep" to bind sheet corners without a staple. The position relationship among the binding positions will be described.

[Multi-Binding]

As shown in FIG. 4, the multi-binding processing is to perform the binding processing on the end edge (in the apparatus shown in the figure, the rear end edge) of a bunch of sheets (hereinafter, referred to as "a bunch of aligned sheets") positioned on the processing tray 12 by the sheet end regulation members 16 and side alignment members 31. In FIG. 4, the binding positions Ma1, Ma2 to perform the binding processing on two portions are set at a distance. The staple unit 14 described later shifts from the home position to the binding position Ma1, and then to Ma2 in this order to perform the binding processing in each position. In addition, the multi-binding positions Ma are not limited to two portions, and there is the case that three or more portions undergo the binding processing.

[Corner Binding]

In the corner binding processing, the binding position is set on two right and left portions i.e. the right corner binding position Cp1 to perform the binding processing on a right corner of a bunch of aligned sheets collected on the processing tray 12, and the left corner binding position Cp2 to perform the binding processing on a left corner of a bunch of aligned sheets. In this case, a staple is inclined a predetermined angle (about 30 degrees to about 60 degrees) to perform the binding processing. (The staple unit 14 described later is mounted on the apparatus frame so that the entire unit is inclined a predetermined angle in this position.)

The apparatus specifications shown in the figure show the case of selecting one of the right and the left of a bunch of sheets to perform the binding processing, and the case of inclining the staple a predetermined angle to perform the binding processing. The present invention is not limited thereto, and it is also possible to adopt a configuration for performing corner binding on only one of the right and left, and another configuration for binding in parallel with the sheet end edge without inclining the staple.

[Manual Binding]

The manual binding position Mp is disposed on the manual set surface 25*a* formed in the exterior casing 20*b* (a part of the apparatus housing) described later. The manual set surface 25*a* is disposed (parallel disposed) in a position adjacent to the support surface 12*a* via the side frame 20*c*, in a height forming almost the same plane as the support surface 12*a* of the processing tray 12. In the apparatus shown in the figure, both the support surface 12*a* of the processing tray and the manual set surface 25*a* support sheets in an approximately horizontal posture, and are disposed in approximately the same height positions.

In other words, in FIG. 4, via the side frame 20*c*, the manual set surface 25*a* is disposed to the right of the frame 20*c*, and the support surface 12*a* is disposed to the left of the frame 20*c*. Then, the manual binding position Mp is disposed in line with the multi-binding position Ma, described previously, disposed on the paper mount surface. This is because the common staple unit 14 performs the binding processing on both of the binding positions. Accordingly, the sheet carry-in area Ar is disposed in the processing tray 12, the manual feed area Fr is disposed on the apparatus front side thereof, and the eco-binding area Rr described later is disposed on the apparatus rear side.

[Without-Staple Binding Position]

The without-staple binding position Ep (hereinafter, referred to as "eco-binding position") is disposed so as to perform the binding processing on a side edge portion (corner portion) of sheets as shown in FIG. 4. The eco-binding position Ep shown in the figure is disposed in a position to perform the binding processing on one portion in the side edge portion in the sheet discharge direction of a bunch of sheets, and is to perform the binding processing in an angle position inclined a predetermined angle with respect to the sheets. Then, the eco-binding position Ep is disposed in the eco-binding area Rr away from the sheet carry-in area Ar of the processing tray 12 to the apparatus rear side.

[Relationship Among Binding Positions]

The multi-binding positions Ma1, Ma2 are disposed inside the carrying-out area Ar (inner side) of sheets carried in the processing tray 12 from the sheet discharge outlet 11. Further, the corner binding positions Cp1, Cp2 are disposed, outside the sheet carry-in area Ar, in reference positions (side alignment reference) spaced a predetermined distance away from the sheet discharge reference Sx (center reference) of sheets to the right or left of the Sx.

The multi-binding positions Ma1, Ma2 and manual binding position Mp are disposed substantially in a straight line. Further, the corner binding positions Cp1, Cp2 are set for respective inclined angles (for example, 45-degree angle position) that are bilateral symmetry with respect to the sheet discharge reference Sx.

The manual binding position Mp is disposed in the manual feed area Fr on the apparatus front side outside the sheet carry-in area Ar, and the eco-binding position Ep is disposed in the eco-binding area Rr on the apparatus rear side outside the sheet carry-in area Ar.

Further, the manual binding position Mp is disposed in a position offset by a predetermined amount (Of1) from the right corner binding position of the processing tray 12, and the eco-binding position Ep is disposed in a position offset by a predetermined amount (Of2) from the left corner binding position of the processing tray 12. Thus, the multi-binding positions Mp are set based on the carrying-out reference (center reference) of the processing tray 12 to carry in sheets, the corner binding positions Cp are set based on the maximum size sheet, and further, from the right and left corner binding positions, the manual binding position Mp is set in the position provided with the predetermined amount offset Of1 to the apparatus front side, while the eco-binding position Ep is set in the position provided with the predetermined amount offset Of2 to the apparatus rear side similarly. By this means, it is possible to arrange neatly without sheet shifts interfering mutually.

The sheet shift in each binding processing will be described. In the multi-binding processing, sheets are carried in the processing tray in the center reference (that may be the side reference), are aligned in this state, and undergo the binding processing. After the binding processing, the sheets are carried out to the downstream side in the posture. In the corner binding processing, sheets are aligned in the alignment position on the designated side, and undergo the binding processing. After the binding processing, the sheets are carried out to the downstream side in the posture. Further, in the eco-binding processing, sheets carried onto the processing tray are collected in the shape of a bunch, then undergo the predetermined amount offset Of2 to the apparatus rear side, and after the offset shift, undergo the binding processing. After the binding processing, the sheets are offset by a predetermined amount (for example, the same as or smaller than the offset Of2) to the sheet center side, and then, are carried out to the downstream side.

Further, in manual binding, an operator sets sheets on the manual set surface spaced the predetermined offset Of1 away from the alignment reference positioned on the front side from the processing tray 12. By this means, in a plurality of types of binding processing, set positions of sheets are allocated in the transport orthogonal direction to execute the binding processing, and therefore, it is possible to perform the processing such that the processing speed is prompt and that sheet jams are few.

In addition, in the eco-binding processing, the controller 75 described later offsets sheets by a predetermined amount from the rear end reference position to the sheet discharge direction to set the binding position Ep. This is because of avoiding interference between the staple unit 14 for left corner binding of sheets and the eco-binding unit (press bind unit 23 described later). Accordingly, when the eco-binding unit 23 is mounted on the apparatus frame to be able to shift between the binding position and a retracted position retracted from the binding position in the same way as in the staple unit 14, the need for offsetting in the sheet discharge direction is eliminated.

In addition, herein, the apparatus front side Fr refers to the front side of the exterior casing 20*b* set in the apparatus design for an operator to execute various kinds of operation. Generally, on this apparatus front side are disposed a control panel, and an insertion cover (door) of sheet cassettes or an open/close cover to add staples of the staple unit. Further, the apparatus rear side Re refers to the side (in terms of design, installation condition that a wall exists on the back) facing the wall of the structure in installing the apparatus, for example.

Thus, in the apparatus shown in the figure, with reference to the sheet carry-in area Ar, outside the area, the manual binding position Mp is disposed on the apparatus front side Fr, and the eco-binding processing Ep is disposed on the apparatus rear side Re. At this point, the distance between the reference (sheet carry-in reference Sx) of the sheet carry-in area Ar and the manual binding position Mp is set to be longer (farther position) than the distance between the carry-in reference Sx and the eco-binding position Ep.

The reason why the manual binding position Mp is set at a position away from the sheet carry-in reference (Sx) of the processing tray 12 and the eco-binding position Ep is set at a close position near the carry-in reference is convenience that in setting a bunch of sheets in the manual binding position Mp from the outside, the operation is easy because the position is away from the processing tray 12. Concurrently therewith, the reason why the eco-binding position Ep is set at the position (near) close to the carry-in reference Sx is to decrease a shift amount in offset-shifting sheets (a bunch of aligned sheets) carried onto the processing tray to the binding position and to perform the binding processing speedily (to improve productivity).

[Shift Mechanism of the Staple Unit]

In the staple unit 14 (first binding processing device), a unit frame (referred to as first unit frame) is equipped with a staple cartridge 26, staple head and anvil member. This staple unit 14 is supported on the apparatus frame 20 so as to reciprocate by a predetermined stroke along the sheet end surface on the processing tray 12. The support structure will be described below.

Figure 6:
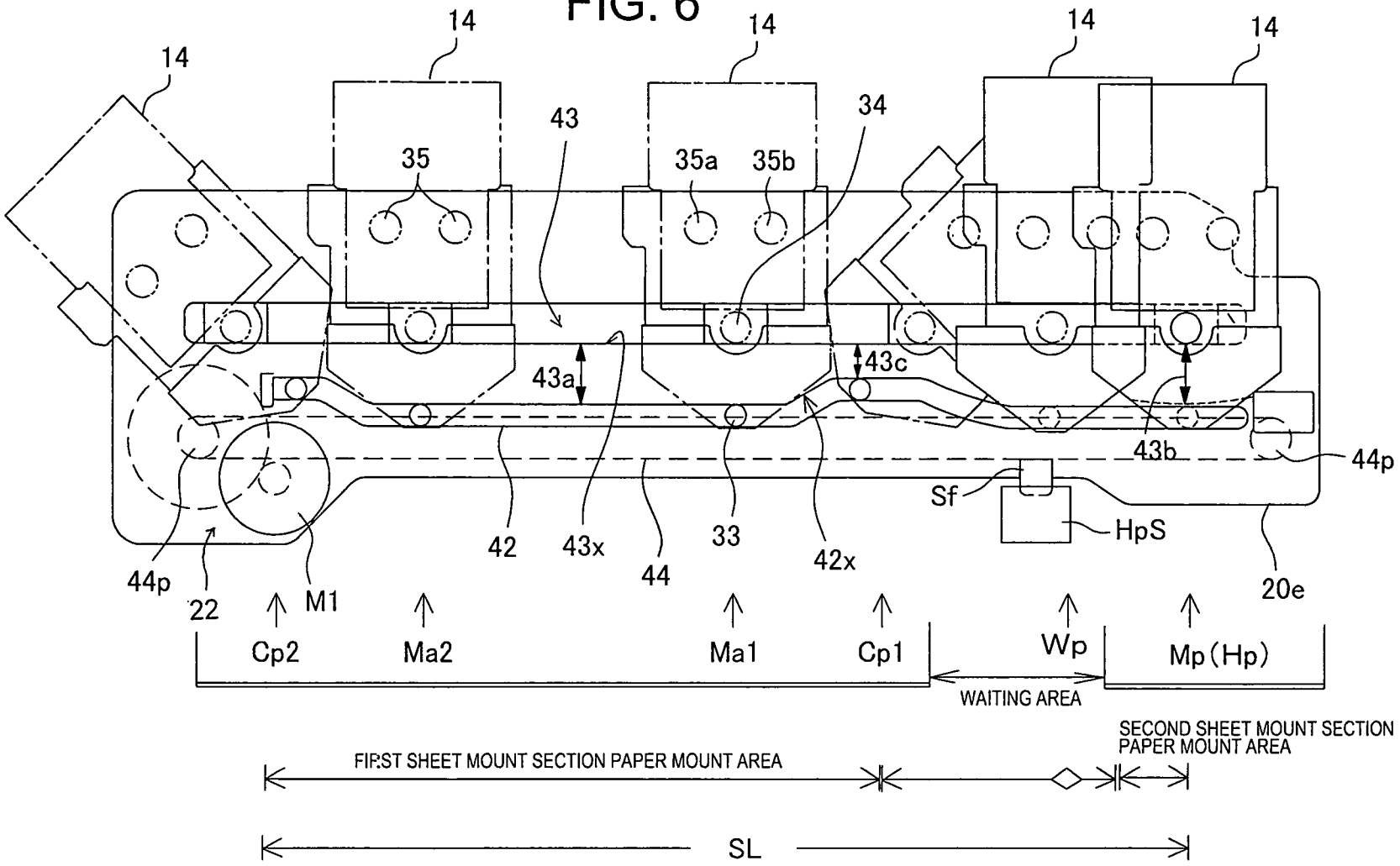
FIG. 6 is an explanatory view of a shift mechanism of a staple unit in the post-processing apparatus.

FIG. 7 illustrates a side configuration that the staple unit 14 is installed in the apparatus frame 20. As shown in FIGS. 4 and 6, a chassis frame 20*e* (hereinafter, referred to as "bottom frame") is disposed in the right and left side frames 20*c*, 20*d* forming the apparatus frame 20. The staple unit 14 is mounted on the bottom frame 20*e* to be able to shift by a predetermined stroke.

In the bottom frame 20*e* are disposed a travel guide rail 42 (hereinafter, simply referred to as "guide rail") and slide cam 43. A travel rail surface 42*x* is formed in the guide rail 42, a travel cam surface 43*x* is formed in the slide cam 43, and the travel rail surface 42*x* and travel cam surface 43*x* cooperate to support the staple unit 14 (hereinafter, referred to as "shift unit" in this section) to be able to reciprocate by a predetermined stroke, and concurrently control the angle posture.

In the guide rail 42 and slide cam 43 are formed the rail surface 42*x* and cam surface 43*x* so as to reciprocate in the shift range (sheet carry-in area, manual feed area and eco-binding area) SL of the shift unit (see FIG. 6). The travel guide rail 42 is comprised of a rail member having the stroke SL along the rear end regulation members 16 of the processing tray 12, and in the apparatus shown in the figure, is comprised of an opening groove formed in the bottom frame 20*e*. In the opening edge is formed the travel rail surface 42*x*, and this travel rail surface is disposed in line with the rear end regulation members 16 of the processing tray in a mutually parallel relationship. Further, the slide cam 43 is disposed at a distance from the travel rail surface, and in the apparatus shown in the figure, is comprised of a groove cam formed in the bottom frame 20*e*. The travel cam surface 43*x* is formed in this groove cam.

The shift unit (staple unit) 14 is fixed to a travel belt 44 coupled to a drive motor (travel motor) M1. The travel belt 44 is wound around a pair of pulleys 44*p* axially supported by the apparatus frame 20*e*, and one of the pulleys is coupled to the drive motor M1. Accordingly, by forward and backward rotation of the travel motor M1, the staple unit 14 reciprocates by the stroke SL.

In the travel rail surface and the travel cam surface are formed mutually-parallel parallel interval portions (span 1) 43*a*, 43*b*, narrow swing interval portions (span 2) 43*c*, 43*d* and narrower-interval swing interval portion (span 3) 43*e*. Then, intervals are configured in the relationship of span 1>span 2>span 3. The unit 14 changes the swing angle so that the unit 14 is in a posture parallel with the sheet rear end edge in the span 1, is in a posture inclined leftward or rightward in the span 2, and is in a further inclined angle posture in the span 3.

In addition, as the travel guide rail 42, not limited to the opening groove structure, it is possible to adopt a guide rod, protrusion-shaped rib and other various structures. Further, the slide cam 42 is not limited to the groove cam, and it is possible to adopt various types in the shape such as a protrusion thread rib member which is provided with a cam surface that guides the shift unit 14 to the predetermined stroke direction.

The shift unit 14 engages in the travel guide rail 42 and slide cam 43 as described below. As shown in FIG. 7, the shift unit 14 is provided with a first rolling roller 33 (rail fit member) that engages in the travel rail surface 42*x*, and a second rolling roller 34 (cam follower member) that engages in the travel cam surface 43*x*. Concurrently therewith, in the shift unit 14 is formed slide rollers 35 that engage in the support surface of the bottom frame 20*e* (in the apparatus shown in the figure, ball-shaped slide rollers 35*a*, 35*b* are formed in two portions.) Further, a guide roller 36 that engages in the bottom surface of the bottom frame is formed in the shift unit 14 to prevent the shift unit 14 from floating from the bottom frame.

By the above-mentioned configuration, the shift unit 14 is supported on the bottom frame 20*e* movably by the slide rollers 35*a*, 35*b* and guide roller 36. Concurrently therewith, the first rolling roller 33 and second rolling roller 34 travel and shift along the rail surface 42*x* and cam surface 43*x*, while rotating along the travel rail surface 42*x* and travel cam surface 43*x*, respectively.

Then, in the interval between the rail surface 42*x* and the cam surface 43*x*, the parallel span portion (span 1) is formed in a position 43*a* shown in the figure opposed to the multi-binding positions Ma1, Ma2 as described previously, and a position 43*b* shown in the figure opposed to the manual binding position Mp. In the span 1, the shift unit 14 is held in a posture orthogonal to the sheet end edge without swinging. Accordingly, in the multi-binding positions Ma and manual binding position Mp, a bunch of sheets undergoes the binding processing with a staple parallel to the sheet end edge.

Further, in the interval between the rail surface 42*x* and the cam surface 43*x*, the swing interval (span 2) is formed in a position 43*e* shown in the figure opposed to the right corner binding position, and in a position 43*d* shown in the figure opposed to the left corner binding position. Then, the shift unit 14 is held in a posture inclined to the right inclination angle posture (for example, a rightward inclination of 45 degrees) or to the left inclination angle posture (for example, a leftward inclination of 45 degrees).

Furthermore, in the interval between the rail surface 42*x* and the cam surface 43*x*, the swing interval (span 3) is formed in a position 43*c* shown in the figure opposed to a staple loading position. This span 3 is formed in an interval shorter than the span 2, and in this state, the shift unit 14 is held in the right inclination angle posture (for example, an inclination of 60 degrees). In addition, the reason why the shift unit 14 is changed in the angle in the staple loading position is to match the unit posture with the angle direction in which the staple cartridge 26 is inserted in the unit, and in the relationship with the open/close cover disposed in the exterior casing, the angle is set.

In deflecting the angle posture of the shift unit with the travel rail surface 42*x* and travel cam surface 43*x* as described above, in terms of compact properties of layout, it is preferable to provide a second travel cam surface so as to shorten a shift length or provide a stopper cam surface to deflect the angle in cooperation with the travel cam surface.

The stopper cam surface shown in the figure will be described. As shown in FIG. 7, in the bottom frame 20*e*, in a position shown in the figure is disposed a stopper surface 43*y* that engages in a part (in the apparatus shown in the figure, rolling roller 35*a*) of the shift unit so as to change the unit posture in the right corner binding position Cp1 on the apparatus front side and the manual binding position Mp. By this means, it is necessary to correct the inclination of the unit 14, which is inclined in the staple loading position, in the manual binding position Mp, but in changing the angle by only the cam surface and rail surface as described previously, the shift stroke is redundant.

Therefore, the unit is returned to the original state from the inclined state by moving the unit to the manual binding side in a state in which the shift unit is locked by the stopper surface 43*y*. Further, in moving back the unit from the manual binding position in the opposite direction, the stopper surface 43*z* (forcibly) inclines the unit toward the corner binding position.

[Stack Tray]

Figure 8:
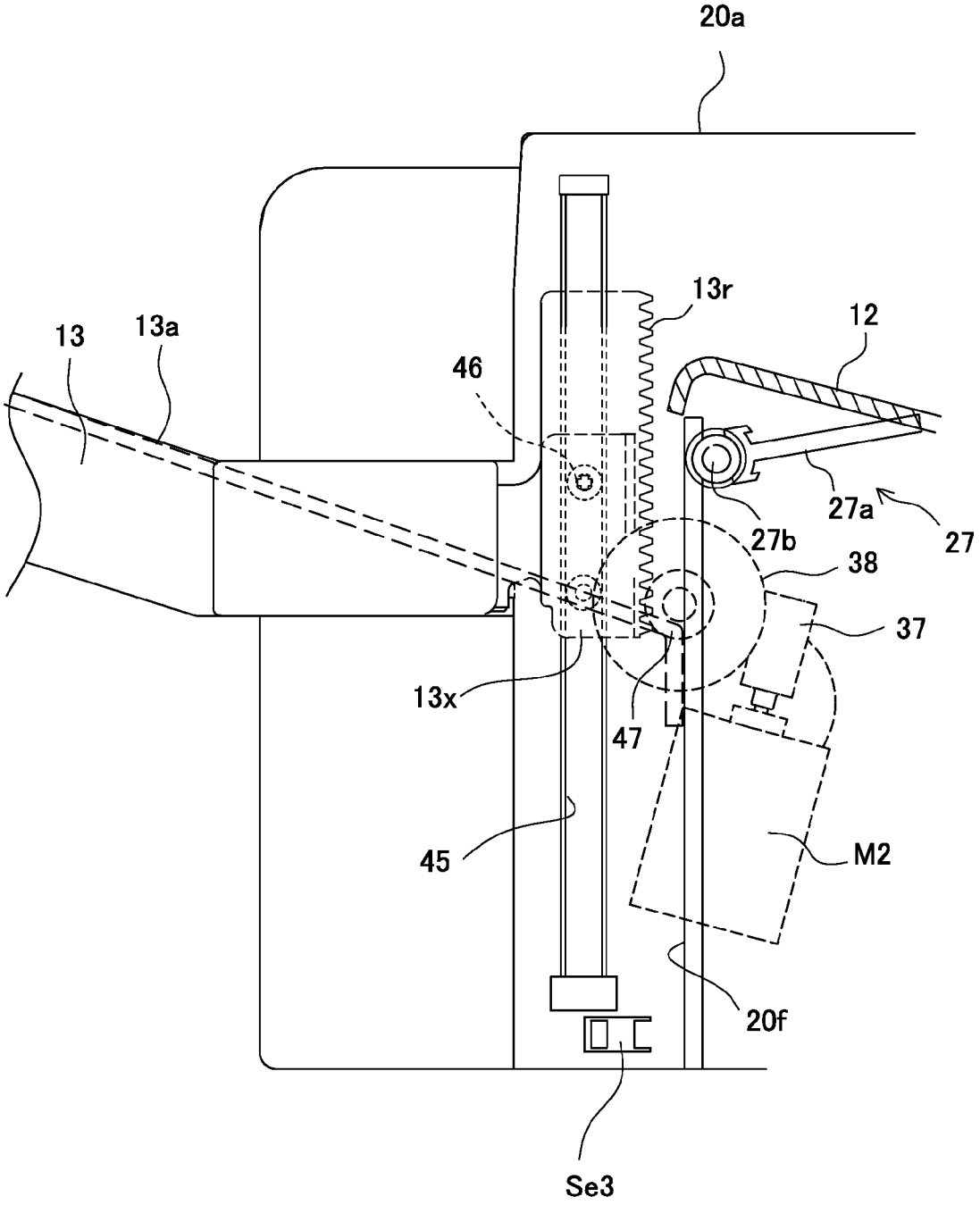
FIG. 8 is an explanatory view of an up-and-down mechanism of a stack tray in the post-processing apparatus.

A configuration of the stack tray will be described according to FIG. 8. The stack tray 13 is disposed on the downstream side of the processing tray 12, and loads and stores a bunch of sheets collected on the processing tray. The stack tray 13 is provided with a tray up-and-down mechanism so that the tray descends sequentially corresponding to a load amount of the stack tray 13. A load surface (uppermost sheet height) of this tray is controlled to a height position that is almost the same plane as the paper mount surface of the processing tray. Further, the loaded sheets are inclined an angle that the rear end edge in the sheet discharge direction strikes a tray alignment surface 20*f* (stand surface) under their own weight.

The specific configuration will be described. An up-and-down rail 45 is fixed to the apparatus frame 20*a* vertically in a load direction, and a tray base 13*x* is fitted into the up-and-down rail slidably with a slide roller 46 or the like to be able to move up and down. Concurrently therewith, a rack 13*r* is integrally formed in the tray base 13*x* in the up-and-down direction, and meshes with a drive pinion 47 axially supported by the apparatus frame. Then, the drive pinion 47 is coupled to an up-and-down motor M2 via a worm gear 37 and a worm wheel 38.

Accordingly, in rotating the up-and-down motor M2 forward and backward, the rack 13*r* coupled to the drive pinion 47 moves up and down to above and below the apparatus frame. By this configuration, the tray base 13*x* performs up-and-down operation in a cantilever state. As the tray up-and-down mechanism, as well as the rack-pinion mechanism, it is possible to adopt a pulley suspend belt mechanism and the like.

The stack tray 13 is integrally attached to the tray base 13*x*, and it is configured that sheets are loaded and stored on the load surface. Further, in the apparatus frame is formed the tray alignment surface 20*f* that supports the rear end edge of sheets vertically in the sheet load direction, and in the apparatus shown in the figure, the tray alignment surface is formed of the exterior casing.

Further, the stack tray 13 integrally attached to the tray base 13*x* is formed, while being inclined an angle shown in the figure, and is set for an angle (for example, 20 degrees to 60 degrees) so that the rear end of sheets strikes the tray alignment surface 20*f* under their own weight.

[Sheet Pressing Mechanism]

The stack tray 13 is provided with a sheet pressing mechanism 27 that presses the uppermost sheet of collected sheets. The sheet pressing mechanism shown in the figure is comprised of an elastic pressing member 27*a* that presses the uppermost sheet, a shaft support member 27*b* that axially supports the elastic pressing member rotatably on the apparatus frame 20*a*, a drive motor that rotates this shaft support member in a predetermined angle direction, and a transfer mechanism thereof. The drive motor not shown is drive-coupled to the drive motor of the sheet bunch carrying-out mechanism as a drive source. In carrying (carrying out) a bunch of sheets in the stack tray 13, the elastic pressing member 27*a* is retracted outside the tray, and after the rear end of the bunch of sheets is stored on the uppermost sheet of the load tray, rotates in a counterclockwise direction viewed in the figure from a waiting position to engage in the uppermost sheet and press.

Further, the elastic pressing member 27*a* is retracted from the sheet surface of the uppermost sheet on the load tray to the retracted position, by initial rotation operation of the drive motor for carrying out a bunch of sheets on the processing tray toward the stack tray.

[Level Sensor]

In the stack tray 13 is disposed a level sensor that detects a sheet surface height of the uppermost sheet, and according to a detection signal of this level sensor, the lift motor described previously is rotated to move up a tray paper mount surface 13*a* to rise. As this level sensor mechanism, various kinds are known, and the mechanism shown in the figure adopts a detection method of applying detection light from the tray alignment surface 20*f* of the apparatus frame to above the tray, detecting the reflected light, and detecting whether or not the sheet exists in the height position.

[Loaded Sheet Amount Sensor]

As in the level sensor, in the stack tray 13 is disposed a sensor for detecting that sheets are removed from the tray. The structure is not described specifically, and for example, it is possible to detect whether or not sheets exist on the load surface, by providing a sensor lever that rotates integrally with the sheet pressing elastic pressing member 27*a* described previously, and detecting the sensor lever with a sensor device. Then, when the height position of the sensor lever is varied (is changed) before and after carrying out of a bunch of sheets, for example, the controller 75 described later halts sheet discharge operation or moves the tray up to a predetermined position.

In addition, such operation is abnormal operation, and is a malfunction that occurs when a user carelessly removes sheets from the load tray during operation of the apparatus, or the like. Further, the stack tray 13 is set for a lower limit position in order for the tray not to move down abnormally, and in the lower limit position is disposed a limit sensor Se3 that detects the tray.

[Image Formation System]

As shown in FIG. 1, the image formation unit A is comprised of the paper feed section 1, image formation section 2, sheet discharge section 3 and signal processing section (not shown), and is incorporated into the apparatus housing 7. The paper feed section 1 is comprised of a cassette 50 that stores sheets, and the section 1 shown in the figure is comprised of a plurality of cassettes 50*a*, 50*b*, 50*c*, and is configured to be able to store sheets of different sizes. Into each of the cassettes 50*a* to 50*c* are incorporated a paper feed roller 51 that feeds out the sheet, and a separation device (separation hook, separation roller, etc.; not shown) for separating sheets on a sheet-by-sheet basis.

Further, the paper feed section 1 is provided with a paper feed path 52 to feed a sheet from each cassette 50 to the image formation section 2. A register roller pair 53 is provided at the path end of the paper feed path 52 to align the front end of the sheet fed from each cassette 50, while causing the sheet to wait until the sheet is fed corresponding to image formation timing of the image formation section 2.

Thus, the paper feed section 1 is comprised of a plurality of cassettes according to apparatus specifications, and is configured to feed sheets of a size selected in a control section to the image formation section 2 on the downstream side. Each cassette 50 is inserted in the apparatus housing 7 to be detachable and attachable so as to enable sheets to be supplied.

The image formation section 2 is capable of adopting various image formation mechanisms that form an image on a sheet. The section shown in the figure indicates an electrostatic type image formation mechanism. As shown in FIG. 1, a plurality of drums 54*a* to 54*d* each comprised of a photoconductor is disposed in the apparatus housing 7 corresponding to color components. In each of the drums 54*a*, 54*b*, 54*c*, 54*d* are disposed an emitter (laser head or the like) 55 and developing device 56. Then, the emitter 55 forms a latent image (electrostatic image) on respective one of the drums 54*a*, 54*b*, 54*c*, 54*d*, and the developing device 56 adds toner ink. The ink image added onto each drum is transferred to a transfer belt 57 for each color component, and the image is synthesized.

The transfer image formed on the belt is transferred to the sheet fed from the paper feed section 1 by a charger 58, is fused by a fuser (heat roller) 4, and then is fed to the sheet discharge section 3.

The sheet discharge section 3 is comprised of the sheet discharge outlet 11 formed in the apparatus housing 7 to carry out the sheet to sheet discharge space 8, and a sheet discharge path 59 to guide the sheet from the image formation section 2 to this sheet discharge outlet. In addition, a duplex path 60 described later is connected to the sheet discharge section 3 to reverse the side of the sheet with the image formed on the frontside so as to feed again to the image formation section 2.

The duplex path 60 reverses the side of the sheet with the image formed on the frontside in the image formation section 2 to feed again to the image formation section 2. Then, the image is formed on the backside in the image formation section 2, and then, the sheet is carried out of the sheet discharge outlet 11. Therefore, the duplex path 60 is comprised of a switchback path for reversing the transport direction of the sheet fed from the image formation section 2 to return to the inside of the apparatus, and a U-turn path 60*a* for reversing the side of the sheet that is returned to the inside of the apparatus. In the apparatus shown in the figure, the switchback path is formed in the sheet discharge path (sheet carry-in path) 10 of the post-processing apparatus B described later.

[Image Read Unit]

The image read unit (scatter apparatus) C is comprised of a platen 61, and a read carriage 62 that reciprocates along the platen. The platen 61 is formed of transparent glass, and is comprised of a stationary image read surface that scans a stationary image by a shift of the read carriage 62, and a travel image read surface that reads an original document image traveling at a predetermined velocity.

The read carriage 62 is comprised of a light source lamp, reflecting mirror that changes reflected light from the original document, and photoelectric converter (not shown). The photoelectric converter is comprised of a line sensor arranged in the original document width direction (main scanning direction) on the platen, and the read carriage 62 reciprocates and shifts in the sub-scanning direction orthogonal thereto, and thereby reads the original document image line-sequentially. Further, an automatic document feeder unit (feeder apparatus) D that causes the original document to travel at a predetermined velocity is mounted above the travel image read surface of the platen 61. The automatic document feeder unit D is comprised of a feeder mechanism for feeding original document sheets set on the paper feed tray to the platen 61 on a sheet-by-sheet basis, and storing the sheets in a sheet discharge tray after reading the image.

[Explanation of the Control Configuration]

Figure 9:
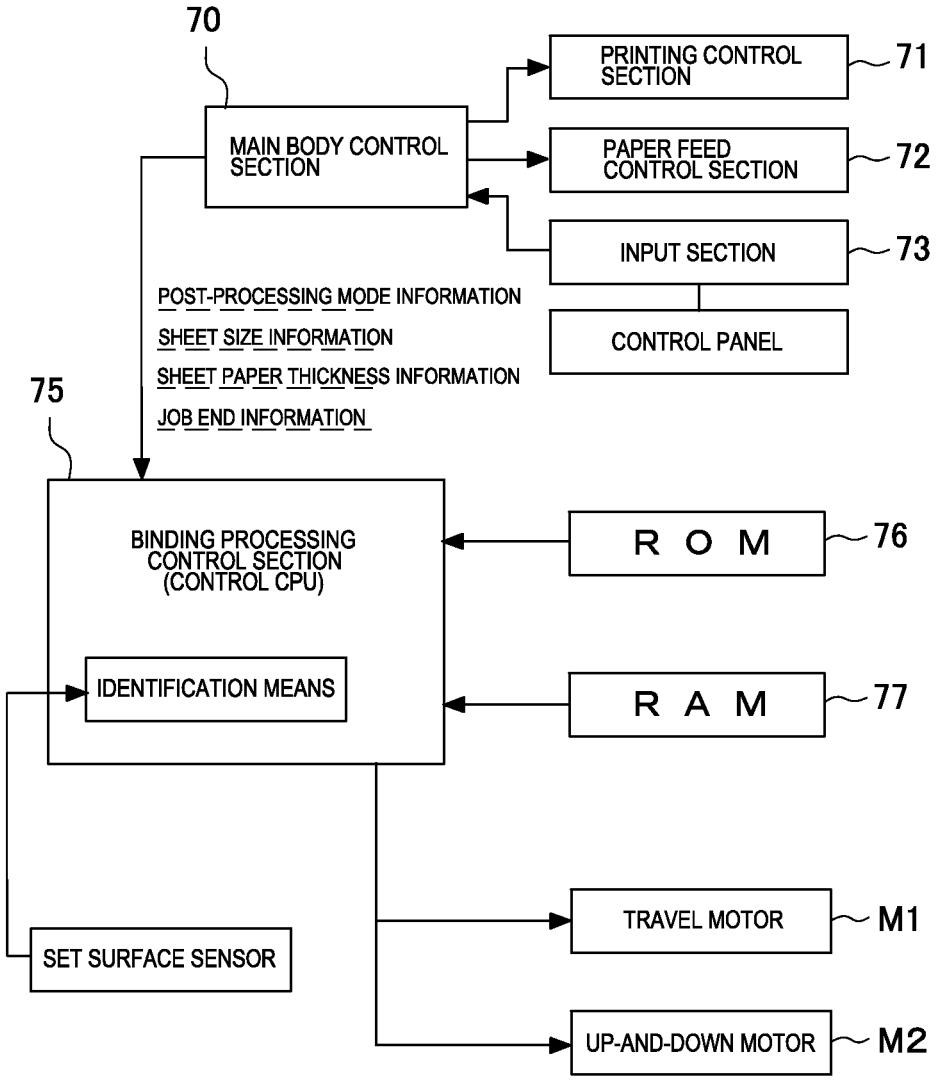
FIG. 9 is an explanatory view of a control configuration in the system of FIG. 1.

The control configuration of the image formation system as described above will be described according to a block diagram of FIG. 9. The image formation system is provided with a control section 70 (hereinafter, referred to as "main body control section") of the image formation apparatus A, and the control section 75 (hereinafter, referred to as "binding processing control section") 75 of the post-processing apparatus B (sheet bunch binding processing apparatus; the same in the following description). The main body control section 70 is provided with a printing control section 71, paper feed control section 72 and input section 73 (control panel).

Then, an "image formation mode" and "post-processing mode" are set from the input section 73 (control panel). The image formation mode is to set mode setting such as color•monochrome printing and two-sided•one-sided printing, and image formation conditions such as the sheet size, sheet paper quality, the number of printout copies and scaling printing. Further, for example, the "post-printing mode" is set at a "printout mode", "staple binding processing mode", "eco-binding processing mode", "jog sorting mode" or the like. In addition, the apparatus shown in the figure is provided with a "manual binding mode", and in this mode, executes binding processing operation of a bunch of sheets in offline independently of the main body control section 70 of the image formation apparatus A.

Further, the main body control section 70 transfers data such as the post-processing mode, the number of sheets, number-of-copy information, and paper thickness information of sheets to perform image formation to the binding processing control section 75. Concurrently therewith, whenever finishing image formation, the main body control section 70 transfers a job end signal to the binding processing control section 75.

The above-mentioned post-processing mode will be described. In the "printout mode", sheets from the sheet discharge outlet 11 are stored in the stack tray 13 via the processing tray 12 without performing the binding processing. In this case, the sheets are stacked and collected on the processing tray 12, and a bunch of the collected sheets is carried out to the stack tray 13 with a jog end signal from the main body control section 70.

In the "staple binding processing mode (second sheet discharge mode)", sheets from the sheet discharge outlet 11 are collected and collated on the processing tray, and this bunch of the sheets is subjected to the binding processing, and then, is stored in the stack tray 13. In this case, as sheets to undergo image formation, in principle, an operator designates sheets with the same paper thickness and the same size. In this staple binding processing mode, one of "multi-binding", "right corner binding" and "left corner binding" is selected and designated. Each binding position is as described previously.

In the "jog sorting mode", sheets subjected to image formation in the image formation apparatus A are sorted into a group to collect on the processing tray while offsetting and another group to collect without offsetting, and in the stack tray 13, a bunch of offset sheets and a bunch of sheets without being offset are stacked alternately. Particularly, in the apparatus shown in the figure, an offset area (see FIG. 4) is provided on the apparatus front side to sort into a group to collect sheets, which are carried out of the sheet discharge outlet 11 onto the processing tray in the center reference Sx, in this posture, and another group to collect sheets similarly carried out in the center reference Sx, while offsetting to the apparatus front side Fr by a predetermined amount.

The reason why the offset area is thus disposed on the apparatus front side Fr is to secure an operation area for the manual binding processing, staple cartridge replacement processing and the like on the apparatus front side. Further, this offset area is set at dimensions (about several centimeters) to sort a bunch of sheets.

[Manual Binding Mode]

In the exterior casing 20*b*, on the apparatus front side is provided the manual set section 25 for an operator to set a bunch of sheet to perform the binding processing. A sensor (not show) to detect a set bunch of sheets is disposed in the manual set surface 25*a* of the manual set section 25, and with a signal from this sensor, the binding processing control section 75 described later shifts a position of the staple unit 14 to the manual binding position. Then, it is configured that the binding processing is executed when the operator presses an operation switch 24.

Accordingly, in this manual binding mode, the binding processing control section 75 and the main body control section 70 undergo offline control. In addition, when the manual binding mode and the staple binding mode are executed at the same time, mode setting is made to give priority to either of the modes.

[Binding Processing Control Section]

The binding processing control section 75 causes the post-processing apparatus B to operate, corresponding to the post-processing mode set in the image formation control section 70. The binding processing control section 75 shown in the figure is comprised of a control CPU (hereinafter, simply referred to as controller). The control CPU 75 is coupled to ROM 76 and RAM 77, and executes sheet discharge operation described later with a control program stored in the ROM 76 and control data stored in the RAM 77. Therefore, the control CPU 75 is coupled to respective drive circuits of all the drive motors as described previously, and controls a start, halt and forward/backward rotation of each motor.

[Home Position of the Staple Unit]

In the present invention, the support surface 12*a* of the processing tray 12 and the manual set surface 25*a* support sheets in approximately the same plane, and the staple unit 14 is configured to be able to shift to positions along the rear end edge of sheets supported by the paper mount surface or the set surface. Then, the staple unit 14 is fixed to the travel belt 44 looped between a pair of pulleys 44 forming the stroke SL, and is configured to be able to shift to an arbitrary position in the stroke SL by rotation of the travel motor M1 coupled to one (drive side) of the pulleys (see FIG. 6).

In this travel belt 44 are disposed a position sensor HpS and sensor flag Sf to detect the position thereof (see FIG. 6). Then, the position of the stapler unit 14 coupled to the travel belt 44 is determined with a signal (reference signal) of the sensor and a rotation amount of the travel motor M1. Therefore, the travel motor described previously is comprised of a stepping motor or is configured to enable the rotation amount to be detected with an encoder disposed in the motor rotating shaft. The position sensor HpS shown in the figure is a photosensor attached to the apparatus frame, and the sensor flag Sf is integrally attached to the travel belt. Then, the arrangement is made in the position relationship that the sensor is ON when the staple unit 14 is in the home position Hp.

In such a configuration, the present invention is characterized in that the stapler unit 14 waits in the manual feed area Fr in "operation modes (hereinafter, referred to as "non-staple operation modes") in which sheets on the processing tray do not undergo staple binding". In other words, except operation modes in which the staple unit is caused to wait in the carry-in area Ar to carry sheets onto the processing tray, and performs staple binding on a bunch of collected sheets, the staple unit is always caused to wait in manual.

In this case, (1) the home position HP of staple unit 14 is set in the manual feed area Fr (outside the sheet carry-in area), or (2) in the non-staple operation modes, in starting operation, the staple unit 14 is position-shifted from the home position Hp to the manual feed area Fr to wait. Either of the methods is adopted.

Further, when the staple unit 14 is initially set in the manual feed area Fr (the home position is set or waiting is set), the position is set at (1) the manual binding position Mp or is set (2) at a position except the manual binding position, and either of the positions is selected.

In setting at the binding position of (1), when a bunch of sheets is set on the manual set surface 25*a* and the operation button 24 is turned ON, the operation immediately shifts to the binding operation. In setting in the manual feed area Fr except the binding position of (2), after a bunch of sheets is set on the manual set surface 25*a* and the operation button 24 is turned ON, the staple unit 14 shifts to the binding position to perform the binding processing. Therefore, when the staple unit 14 does not shift (shift noise does not occur) even in operating the operation button 24, a warning to suspect an apparatus failure is issued.

The controller 75 is provided with a determination device for determining a shift amount of from "the waiting position to the binding position Mp" of a bunch of sheets set on the manual feed tray 25. For example, this determination device sets a unit shift amount based on a detection signal of the home position sensor of the staple unit as described previously.

For example, (1) when the home position is set at the binding position of the manual feed tray 25 with reference to the home position of the staple unit 14, the detection position is the binding position, and the shift amount of from the waiting position to the binding position is "zero". (2) When the home position is set at a position except the binding position of the manual feed tray 25, the shift amount of from the home position to the binding position of the manual tray η is beforehand stored in the ROM 76 or the like. Moreover, as the determination device for determining the shift amount of from the waiting position to the binding position, a sensor flag and sensor (independently of the home position sensor) to detect the binding position may be disposed in the staple unit 14, travel belt 44 or the like.

Figure 10:
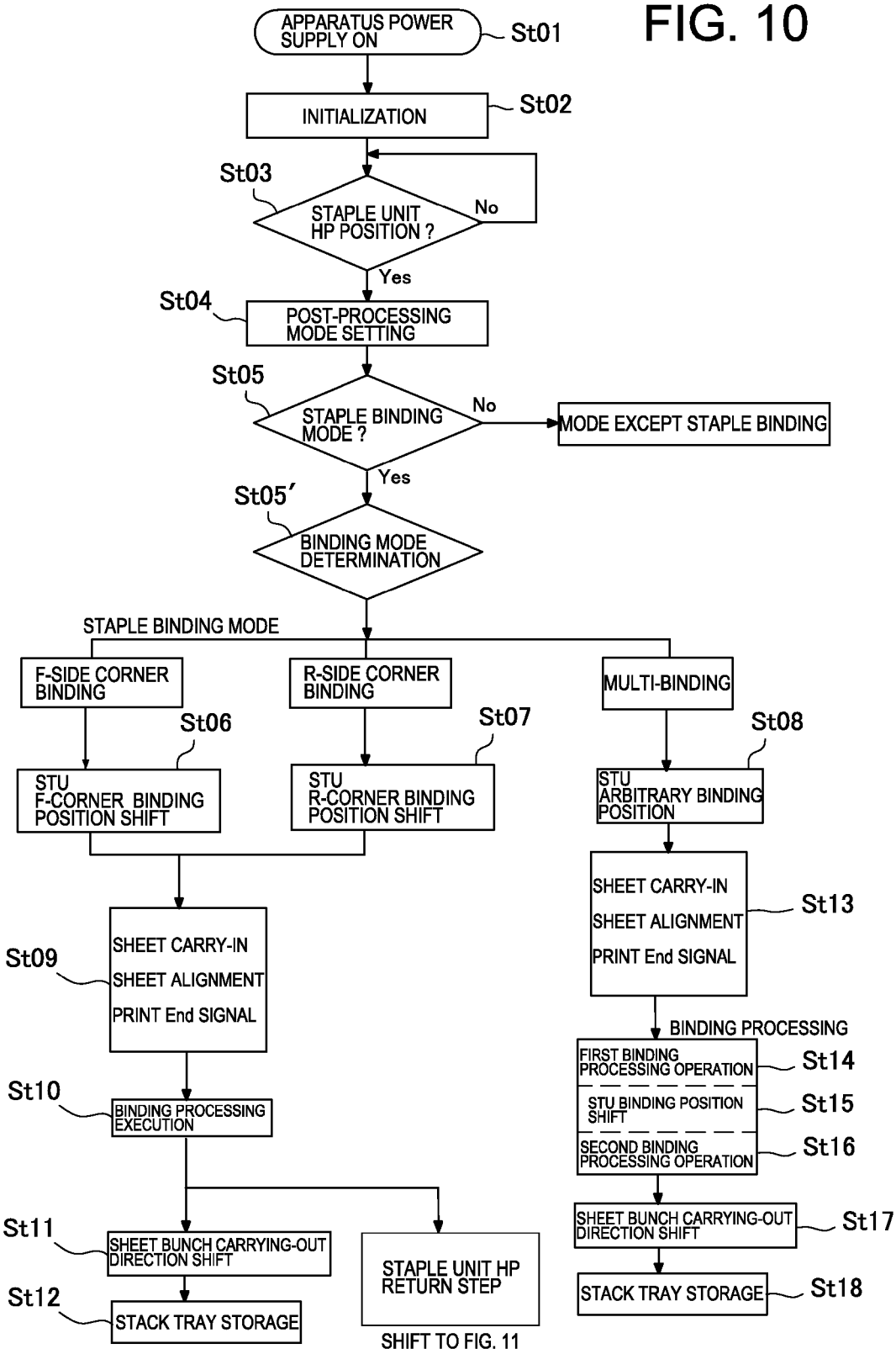
FIG. 10 is a flowchart illustrating operation of the staple unit in the post-processing apparatus.

An operation state of the post-processing operation will be described next according to FIG. 10. The controller 75 determines whether or not the set post-processing mode is the staple binding mode (St05), and in the case of the staple binding mode, determines which staple mode is set (St05') to execute the following operation. Further, in operation modes (eco-binding mode, printout mode, jog sorting mode) except the staple binding mode, the means 75 executes the operation of step St31 and subsequent steps as described later. In the "front side corner binding mode", the controller 75 shifts the staple unit 14 to the corner binding position Cp1 to wait (St06). Further, in the "rear side corner binding mode", the controller 75 shifts the staple unit 14 to the corner binding position Cp2 to wait (St07). Furthermore, in the "multi-binding mode", the means 75 shifts the staple unit 14 to one of a plurality of binding positions to wait (St08). By this means, the staple unit 14 shifts to the binding processing position to wait. In addition, in order to set the waiting position of the staple unit 14, the controller 75 acquires the sheet size information from the image formation apparatus A to calculate the binding position, and sets the waiting position.

Next, upon receiving a sheet discharge instruction signal from the image formation apparatus A, the controller 75 guides an image-formed sheet from the sheet discharge path (sheet carry-in path) 10 onto the processing tray 12. Then, the sheet strikes at the sheet end (in the apparatus shown in the figure, rear end in the sheet discharge direction) the regulation device 16 to regulate, and is aligned in the width by the side alignment device 30. In the apparatus shown in the figure, the means 75 aligns in the side reference with reference to the binding-side side edge in the corner binding mode, while aligning with reference to the sheet center in the multi-binding mode (St13).

Upon receiving a print end signal from the upstream image formation apparatus A, in the corner binding mode, the controller 75 executes the binding processing without shifting the position of the staple unit 14 (St10). Then, the controller 75 shifts a bunch of sheets subjected to the binding processing in the discharge direction (St11), and stores in the stack tray 13 on the downstream side (St12).

Further, in the multi-binding processing, the means 75 executes the first binding operation in the position (St14), next shifts the staple unit 14 to the second binding position (St15), and then, executes the second binding processing operation (St16). Subsequently, the controller 75 shifts a bunch of sheets subjected to the binding processing in the discharge direction (St17), and stores in the stack tray 13 on the downstream side (St18).

Figure 11:
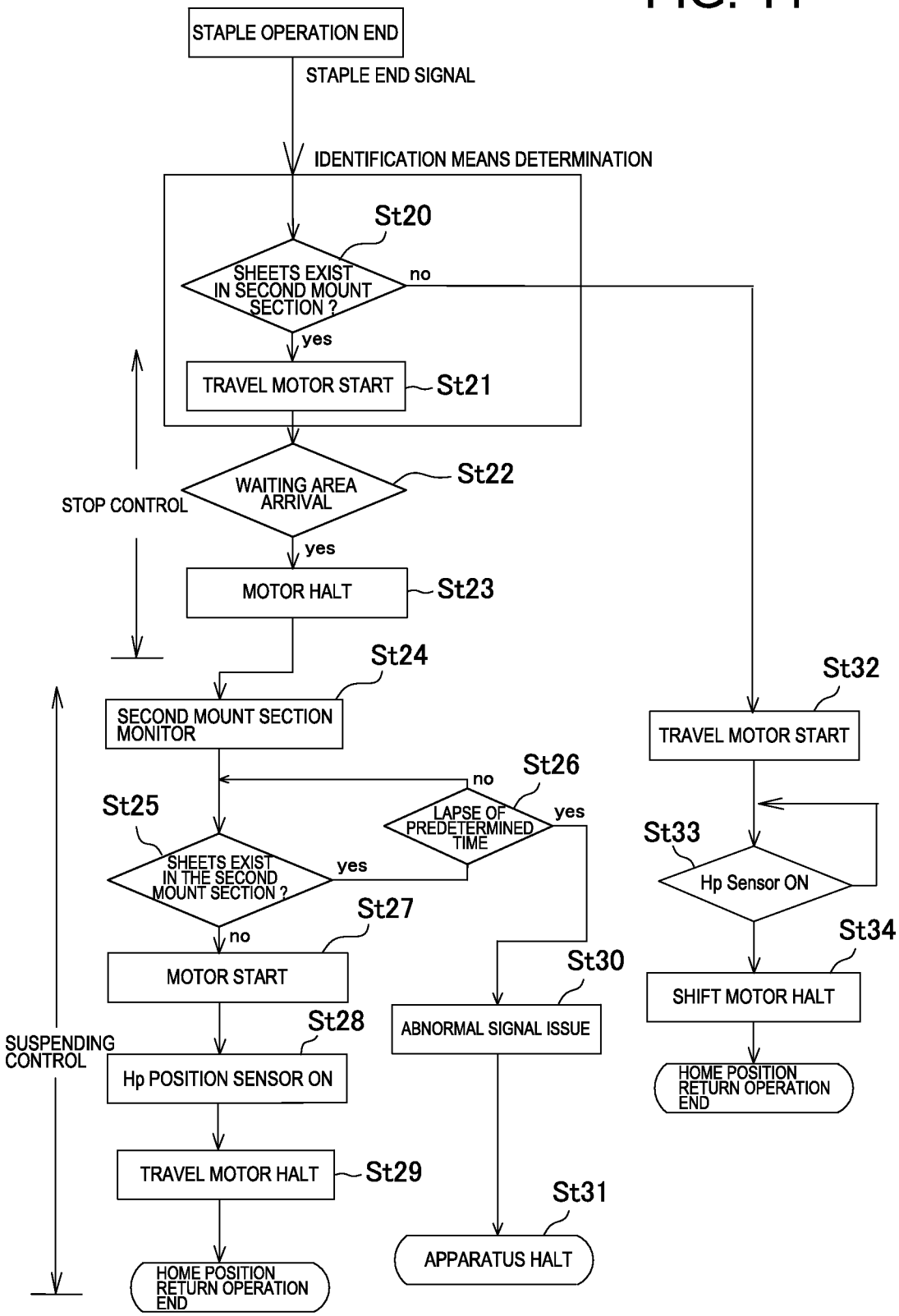
FIG. 11 is a flowchart illustrating position shift operation of the staple unit in staple operation of FIG. 10.

According to FIG. 11, described next is operation for returning the staple unit 14 to the home position. As described previously, after performing the corner binding processing or multi-binding processing on a bunch of sheets collected in the first sheet mount section (processing tray 12), the controller 75 returns the staple unit 14 to the home position Hp, and finishes the post-processing operation.

This finish operation of the staple unit 14 will be described. Upon receiving a staple end signal from the staple unit 14, the controller 75 determines whether or not sheets exist in the sheet mount section (in this case, the second sheet mount section 25*a*) that is the shift destination (St20).

This determination is made in an identification device 75 comprised of the controller (CPU). In the apparatus shown in the figure, (1) a sensor to detect the sheet end is disposed in the second sheet mount section (manual set surface 25*a*), and when this sensor issues a detection signal with the end surface of sheets inserted onto the set surface, it is determined that the sheets exist. Alternatively, (2) in an apparatus configuration provided with an operation switch (not shown) of the manual binding operation, it is determined that sheets exist by whether or not an operator operates the operation switch. In other words, adopted is either the method of determining the presence or absence by directly detecting that a bunch of sheets is inserted into the manual set surface 25*a* with the sensor or the method of determining the presence or absence by detecting the operation for inserting a bunch of sheets.

Therefore, when sheets exist in the second sheet mount section 25*a* as a determination result of the identification device, the controller 75 starts the travel motor M1 (St21). Then, the staple unit 14 shifts from the binding position in which the binding operation is finished toward the home position Hp. When the staple unit 14 arrives at the waiting area Wp (St22), the controller 75 halts the travel motor M1 (St23). For the rotation amount of the travel motor M1 of from the binding position to the waiting position, the motor is comprised of a stepping motor to perform pulse control (PWM control and the like), the rotation amount of the motor is controlled with an encoder, or a sensor disposed in the waiting area detects the position. By the operation of from steps St20 to St23 as described above, when sheets exist in the sheet mount section that is the shift destination, it is possible to perform "control for halting the shift operation of the staple unit".

Further, described is the case of suspending the shift operation of the staple unit 14 in the present invention. In this case, subsequently to previous step St23 (waiting area halt operation), the controller 75 monitors whether or not sheets are removed from the sheet mount section 25 that is the shift destination (St24). For this monitoring, for example, the control CPU 75 watches a state signal of the sheet detection sensor of the manual set surface 25*a* (St25, St26). Then, when the sensor is "OFF" and it is determined that a bunch of sheets is removed from the set surface, the means 75 restarts the travel motor M1 (St27). Then, when the staple unit 14 arrives at the home position and the home position sensor is "ON" (St28), the means 75 halts the travel motor (St29).

In monitoring the sheet mount section 25 that is the shift destination in step St25, when a state that "sheets exist" continues for predetermined time (St26), the controller 75 issues an abnormal signal (St30). This abnormal signal is to warn the control panel of abnormality or to issue an alarm and halt the apparatus (St31).

Next, in the step St20, in shifting the staple unit 14 from the previous binding position to the home position, when the identification device determines that sheets do not exist in the second sheet mount section 25*a* that is the shift destination, the following operation is executed.

The controller 75 starts the travel motor M1 (St32), and continues motor rotation until the position sensor of the home position is turned ON (St33). Then, when the position sensor is turned ON, the means 75 halts the travel motor M1 (St34). Then, by this operation, the staple unit 14 is positioned in the home position Hp, and the return operation is finished.

[Sheet Regulation Member]

Further, by providing the second sheet mount section with a regulation member to block the area of the binding processing device not to receive sheets when the binding processing device does not exist in the second binding position, it is also possible to prevent contact of the area of the binding device and sheets.

In this configuration, the regulation member capable of moving toward or away from the second sheet mount section is disposed, and is disposed to contact the binding processing device via a transfer section. Then, the regulation member blocks the area of the sheet mount section when the binding processing device does not exist in the second binding position, while opening the area of the sheet mount section when the binding processing device exists in the second binding position.

[Detailed Explanation of the Sheet Regulation Device]

A sheet regulation member 100 is provided with a regulation section 100*a* that prevents manual feed sheets from being inserted in the binding processing device area, a rotating shaft 100*b*, and a contact section 100*c* that contacts the binding member. The regulation section 100*a* is attached from a through section 102 provided in the manual insertion section to be able to move toward or away from the manual insertion section, and is configured that the weight is 100*a*<100*b* on the rotating shaft 100*b* as the boundary. Accordingly, at the normal time, 100*a* is raised, becomes a state of protruding to the insertion section (regulation member 100 . . . dotted line in FIG. 12), and therefore, prevents sheets from being inserted in the binding processing device area when the binding processing device does not exist in the binding position.

Figure 12:
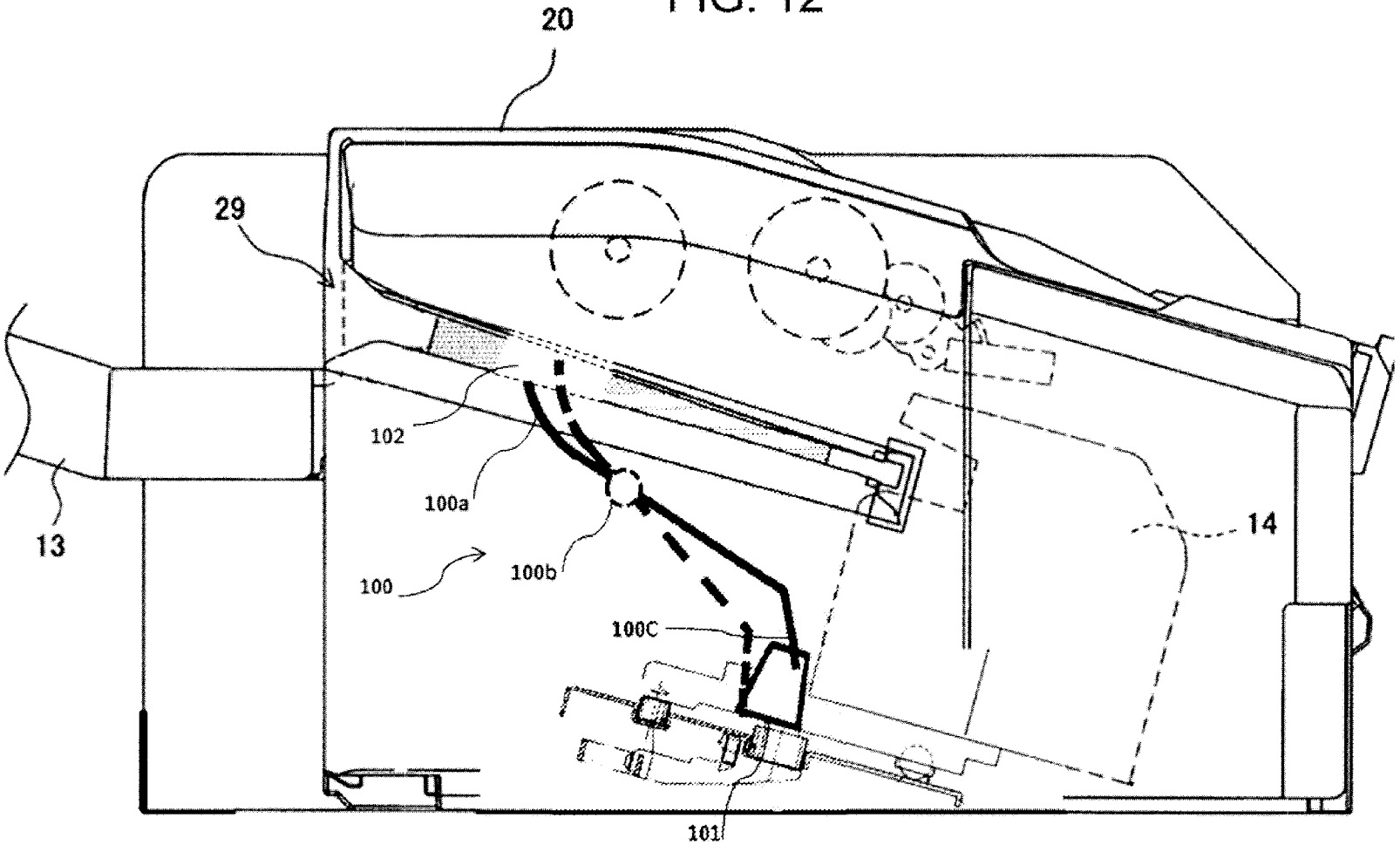
FIG. 12 is an explanatory view of a regulation member.
Figure 13:
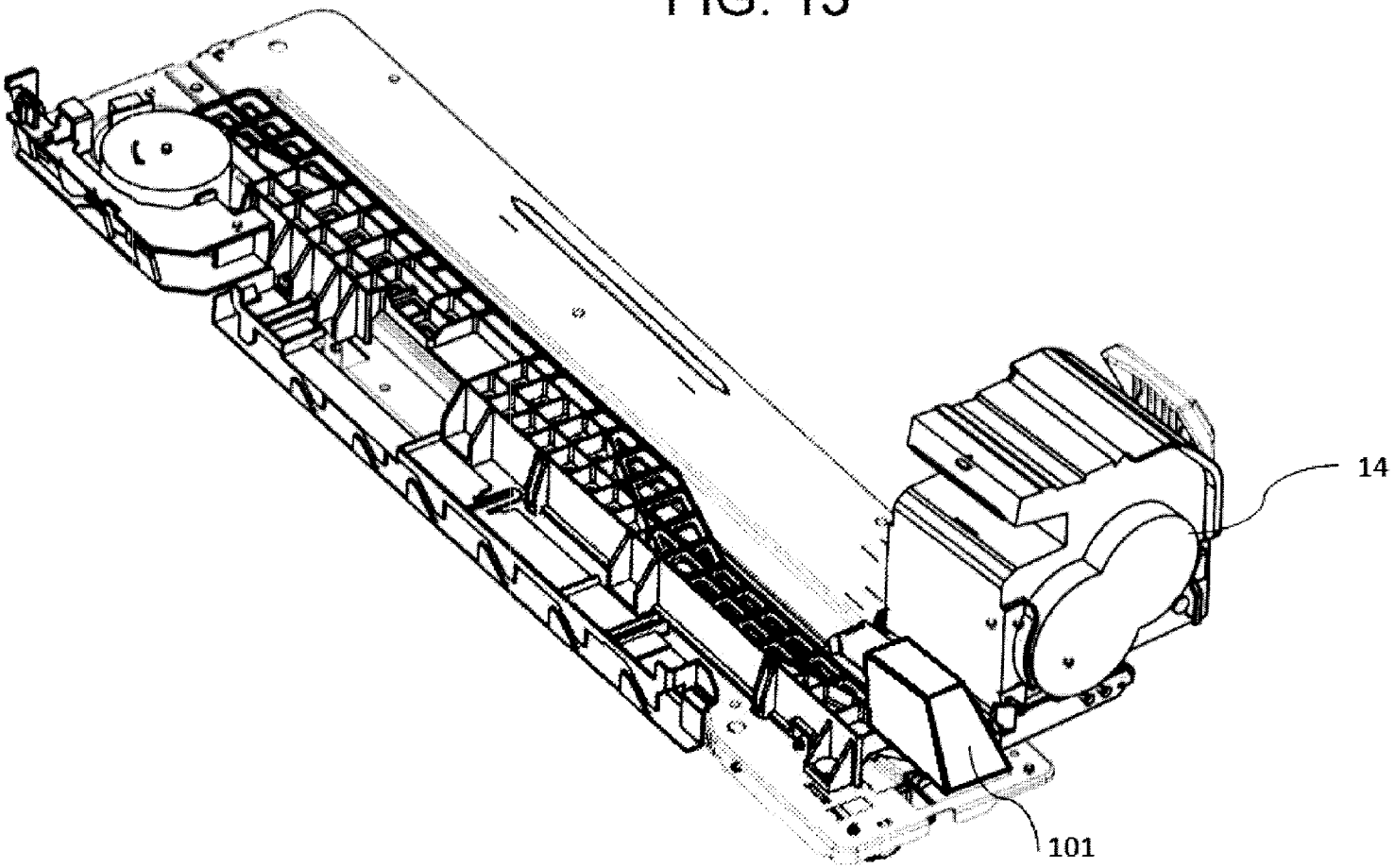
FIG. 13 is a mechanism explanatory view of the regulation member.
Figure 14:
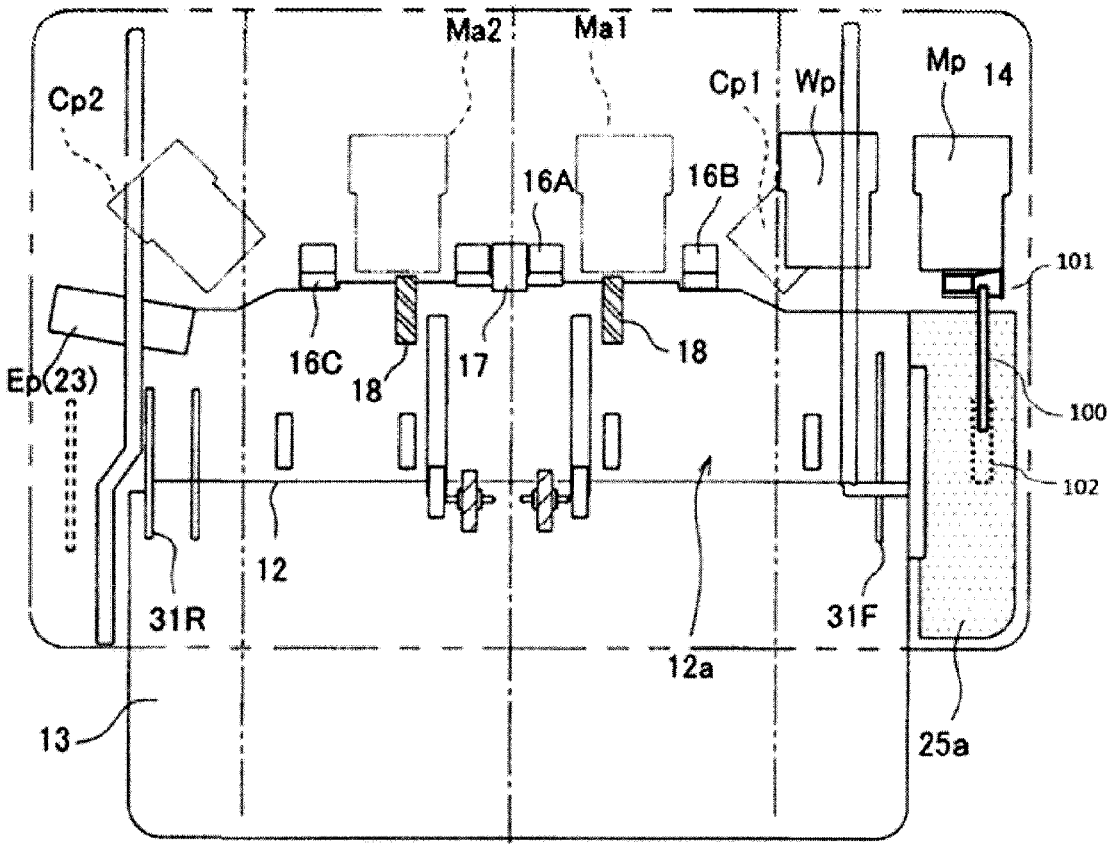
FIG. 14 is another mechanism explanatory view of the regulation member.
Figure 15:
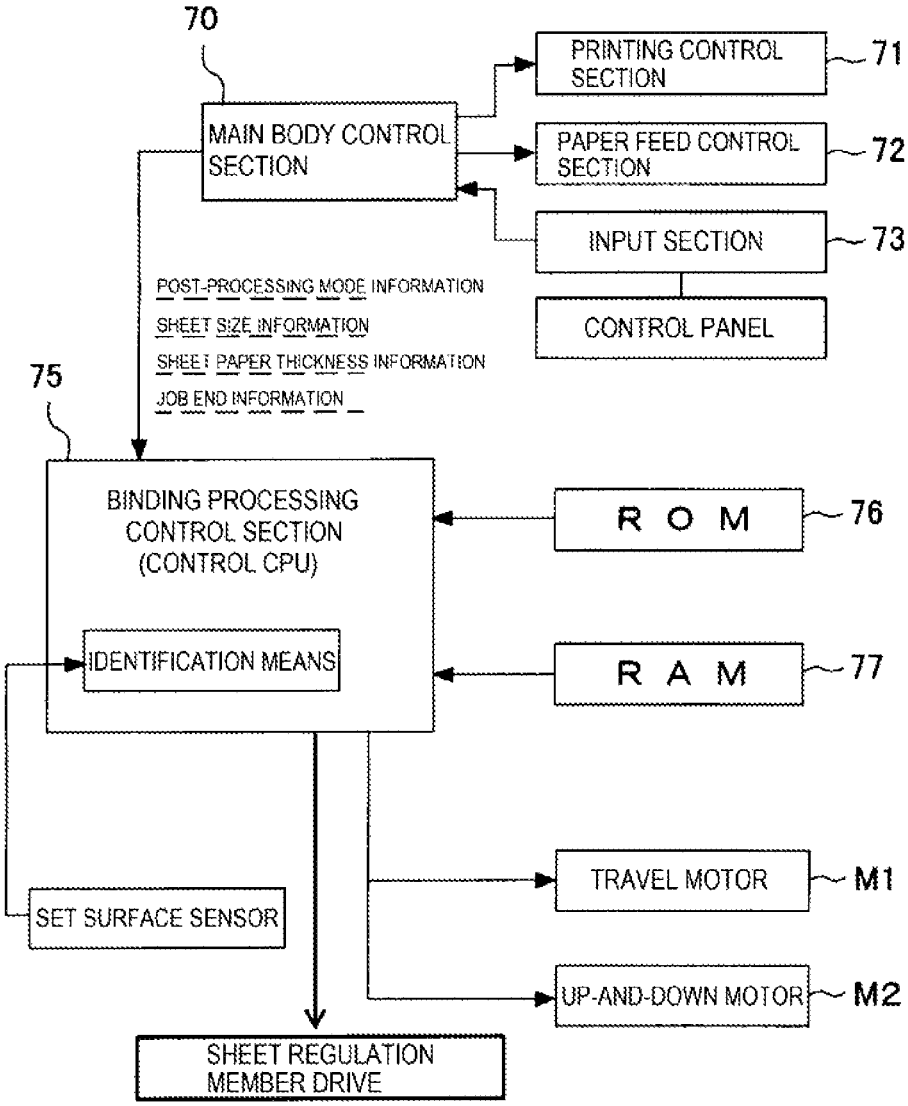
FIG. 15 is an explanatory view of a control configuration in a system of FIG. 12.
Figure 16:
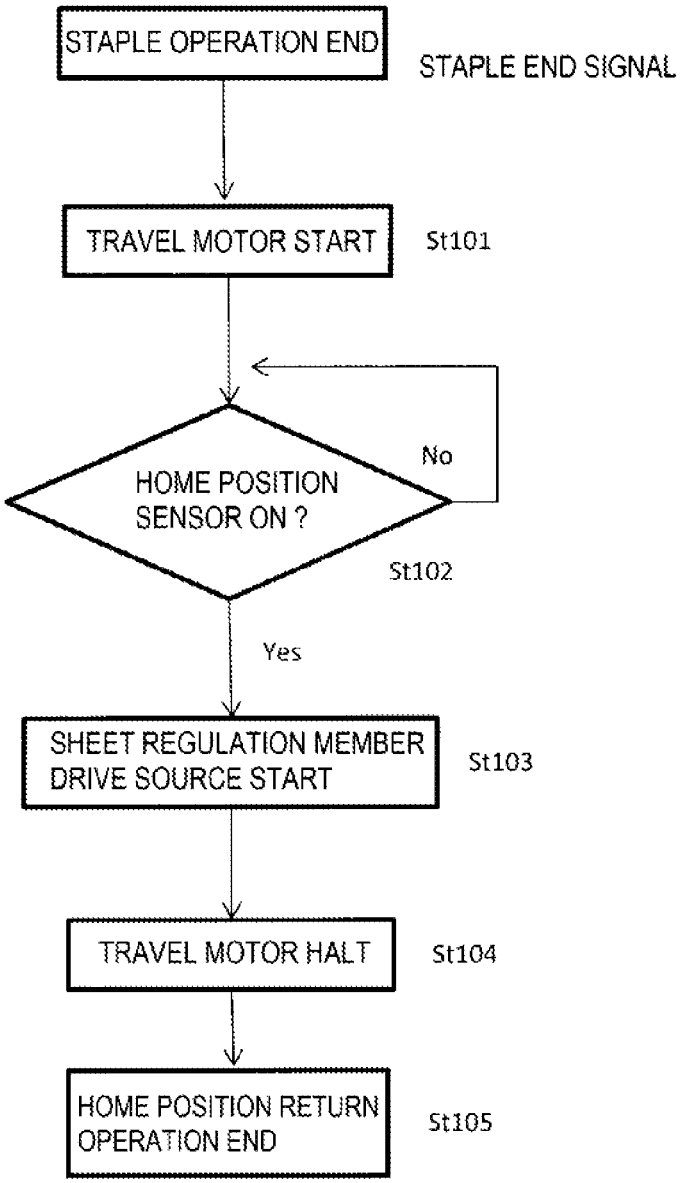
FIG. 16 is a flowchart illustrating position shift operation of the staple unit in FIG. 12.

When the binding processing device shifts to the manual binding position and a lift section 101 provided in the binding processing device contacts the contact portion 100*c*, the contact section 100*c* is lifted, and the regulation section 100*a* becomes a retracted state (regulation member 100 . . . solid line in FIG. 12). By this means, in a state in which the binding processing device is positioned in the manual binding position, it is possible to insert sheets in the sheet mount section. Further, as well as the configuration in which the sheet regulation member is actuated using the shift of the binding processing device as described above, it may be configured that the sheet regulation member is provided with a drive source such as a motor and solenoid, the motor or solenoid is connected to the control CPU as described in FIG. 15, the home position sensor detects that the area of the binding processing device arrives at the second sheet mount section (FIG. 6, St102), and that the control CPU drives the drive source (St103) to open the sheet mount section.

The invention claimed is:

1. A processing apparatus comprising:

a first sheet mount section configured to place sheets;

a second sheet mount section configured to place sheets, the second sheet mount section being arranged at a position different from the first sheet mount section;

a binding processing unit disposed to be able to shift to a first position to bind sheets placed on the first sheet mount section and a second position to bind sheets placed on the second sheet mount section, the second position being different from the first position; and a controller which is configured to position the binding processing unit in a position different from the second position and not to shift the binding processing unit to the second position, in case that the binding processing unit is in a position different from the second position and sheets are placed on the second sheet mount section.

2. The processing apparatus according to claim 1, further comprising an identification device that determines whether or not a sheet exists on the second sheet mount section, wherein in case that the binding processing unit is not positioned in the second position and the identification device determines that a sheet exists on the second sheet mount section, the controller does not shift the binding processing unit to the second position.

3. The processing apparatus according to claim 2, wherein the identification device is comprised of sheet detection device that detects the presence or absence of a sheet disposed on the second sheet mount section.

4. The processing apparatus according to claim 2, further comprising an operation switch device that gives the binding processing unit instructions to bind sheets.

5. The processing apparatus according to claim 1, wherein sheet mount surfaces of the first sheet mount section and the second sheet mount section are disposed approximately on a same plane.

6. The processing apparatus according to claim 1, wherein the first sheet mount section is configured to collect sheets carried from a transport path.

7. The processing apparatus according to claim 1, wherein the binding processing unit is set for a home position in a sheet mount area of the second sheet mount section, and in shifting the binding processing unit to the home position after executing the binding processing on sheets loaded in the first sheet mount section, when a sheet exists in the second mount section, the controller halts the processing unit in a waiting area.

8. The processing apparatus according to claim 1, wherein the binding processing unit is set for a home position in a waiting area.

9. The processing apparatus according to claim 1, wherein sheets manually inserted from an outside of the sheet binding apparatus are placed on the second sheet mount section.

10. A processing apparatus comprising:

a first sheet mount section configured to place sheets;

a second sheet mount section configured to place sheets, the second sheet mount section being arranged at a position different from the first sheet mount section;

a binding processing unit disposed to be able to shift to a first position to bind sheets placed on the first sheet mount section and a second position to bind sheets placed on the second sheet mount section, the second position being different from the first position;

a controller which shifts the binding processing unit from the first position to the second position; and a regulation portion which regulates a sheet so that the sheet is not placed on the second mount section in case that the binding processing unit is not in the second position, and allows a sheet to be placed on the second mount section in case that the binding processing unit is in the second position.

11. The processing apparatus according to claim 10, wherein the regulation portion is configured to be able to shift in conjunction with a shift of the binding processing unit.

12. The processing apparatus according to claim 10, wherein the first sheet mount section is configured to collect sheets carried from a transport path.

13. The processing apparatus according to claim 10, wherein sheets manually inserted from an outside of the sheet binding apparatus are placed on the second sheet mount section.

14. A processing apparatus comprising:

a first sheet mount section configured to place sheets;

a second sheet mount section configured to place sheets, the second sheet mount section being arranged at a position different from the first sheet mount section;

a binding processing unit disposed to be able to shift to a first position to bind sheets placed on the first sheet mount section and a second position to bind sheets placed on the second sheet mount section, the second position being different from the first position;

a controller which shifts the binding processing unit from the first position to the second position; and a regulation portion which blocks an area of the second sheet mount section not to receive sheets in case that the binding processing unit is not in the second position, and opens the area to receive sheets in case that the binding processing unit is in the second position.

15. The processing apparatus according to claim 14, wherein the regulation portion is configured to be able to shift in conjunction with a shift of the binding processing unit.

16. The processing apparatus according to claim 14, wherein sheets manually inserted from an outside of the sheet binding apparatus are placed on the second sheet mount section.

17. The processing apparatus according to claim 14, wherein the first sheet mount section is configured to collect sheets carried from a transport path.

18. A processing apparatus comprising:

a sheet mount section configured to place sheets;

a binding processing unit disposed to be able to shift to a plurality of positions, the binding processing unit in a predetermined position binding sheets placed on the sheet mount section;

a controller which shifts the binding processing unit; and a regulation portion which blocks an area of the sheet mount section not to receive sheets in case that the binding processing unit is not in the predetermined position, and opens the area to receive sheets in case that the binding processing unit is in the predetermined position.

* * * * *